US007371187B2

(12) United States Patent
Moriyama et al.

(10) Patent No.: US 7,371,187 B2
(45) Date of Patent: May 13, 2008

(54) GOLF PUTTER AND METHOD OF DESIGNING THE SAME

(75) Inventors: Keiji Moriyama, Kobe (JP); Masanori Yabu, Kobe (JP)

(73) Assignee: SRI Sports Limited, Kobe (JP)

( * ) Notice: Subject to any disclaimer, the term of this patent is extended or adjusted under 35 U.S.C. 154(b) by 325 days.

(21) Appl. No.: 11/078,453

(22) Filed: Mar. 14, 2005

(65) Prior Publication Data

US 2005/0239573 A1 Oct. 27, 2005

(30) Foreign Application Priority Data

Apr. 23, 2004 (JP) ..... 2004-127863

(51) Int. Cl.
*A63B 53/00* (2006.01)
*A63B 53/04* (2006.01)

(52) U.S. Cl. ..... 473/324; 473/340; 473/409; 473/313; 473/349; 473/341

(58) Field of Classification Search ..... 473/324–350, 473/288–292, 244–248, 313–314, 409
See application file for complete search history.

(56) References Cited

U.S. PATENT DOCUMENTS 3,679,207 A * 7/1972 Florian ..... 473/292
4,203,598 A * 5/1980 Stuff et al. ..... 473/287
4,325,553 A * 4/1982 Taylor ..... 473/337
4,693,478 A * 9/1987 Long ..... 473/251
5,080,365 A * 1/1992 Winchell ..... 473/255
5,094,101 A * 3/1992 Chastonay ..... 73/65.03
5,226,654 A * 7/1993 Solheim ..... 473/313
5,277,059 A * 1/1994 Chastonay ..... 73/65.03
5,409,220 A * 4/1995 Lombardo ..... 473/312
5,439,222 A * 8/1995 Kranenberg ..... 473/309
5,683,307 A * 11/1997 Rife ..... 473/313
5,827,130 A * 10/1998 Jimenez et al. ..... 473/313
5,830,078 A * 11/1998 McMahan ..... 473/252
5,871,407 A * 2/1999 Tseng ..... 473/328
5,947,838 A * 9/1999 Tkacs ..... 473/314
5,951,412 A * 9/1999 Rose et al. ..... 473/340
6,929,564 B2 * 8/2005 Olsavsky et al. ..... 473/340
6,966,846 B2 * 11/2005 Bloom, Jr. ..... 473/292
6,988,959 B2 * 1/2006 Pollman ..... 473/313
2003/0144075 A1 * 7/2003 Cullen ..... 473/340
2005/0137027 A1 * 6/2005 Thomas ..... 473/340
2006/0019765 A1 * 1/2006 Plutt ..... 473/297
2006/0122005 A1 * 6/2006 Nilsson et al. ..... 473/340

FOREIGN PATENT DOCUMENTS

JP 2613849 B2 2/1997

* cited by examiner

*Primary Examiner*—Sebastiano Passaniti
(74) *Attorney, Agent, or Firm*—Birch, Stewart, Kolasch & Birch, LLP

(57) ABSTRACT

Three moments of inertia M1, M2, and M3 (g·cm $^2$) about three axes defined in a golf putter are defined in a manner to provide a weight balance satisfying the expressions {(M1−M2)<12000} and {M1>M2>M3}.

4 Claims, 16 Drawing Sheets

GOLF PUTTER AND METHOD OF DESIGNING THE SAME

BACKGROUND OF THE INVENTION

1. Field of the Invention

The present invention relates to a golf putter club and a method of designing the same.

2. Description of the Related Art

The golf putter club (hereinafter, simply referred to as a golf putter or a putter) is a golf putter principally used for rolling a ball over a surface of a green into a cup. Focusing attention on weight distribution in a head, some of the conventional golf putters are so designed as to concentrate weight on a toe side and a heel side of the head, thereby suppressing the rotation of the head upon impact with the ball so as to provide a wider sweet area. This design concept is set forth in, for example, Japanese Patent Publication No.2613849.

SUMMARY OF THE INVENTION

According to the aforementioned conventional art, the attention is focused on the weight distribution in the head of the golf putter, which includes parts such as a shaft, the head, a grip. In contrast, the present invention is based on a novel technical concept which is absolutely different from the conventional concept. That is, the present invention focuses attention on the whole body of the golf putter rather than the head portion alone. More specifically, the present invention focuses attention on three kinds of moments of inertia of the putter as a whole. Consequently, the present inventors have found that a golf putter featuring a highly stable putting stroke (swing) and excellent directionality of a hit ball is provided.

It is an object of the present invention to provide a golf putter capable of stabilizing the putting stroke and improving the directionality of a hit ball, as well as to provide a method of designing the same.

According to the present invention for achieving the above object, there is provided a golf putter designed to have a weight balance wherein three moments of inertia M1, M2, and M3 (g·cm$^2$) defined by the following descriptions (1) to (3) satisfy the following expressions (A) and (B):

$$(M1-M2)<12000 \quad \text{(A)}$$

$$M1>M2>M3 \quad \text{(B)},$$

(1) M1: a moment of inertia of the putter about a first axis through a reference point P, parallel to a face surface and perpendicular to a shaft axis, the reference point P defined by an intersection of the shaft axis and a perpendicular line from a putter-supporting point on the shaft to the shaft axis in a static balance state of the one-point supported putter;

(2) M2: a moment of inertia of the putter about a second axis through the reference point P and perpendicular to the first axis and to the shaft axis; and (3) M3: a moment of inertia of the putter about a third axis defined by the shaft axis.

In this case, there may be provided a putter stabilizing the putting stroke and featuring the excellent directionality of a hit ball. While these effects have theoretical grounds and are also demonstrated by the examples of the present invention, description on these effects will be made below.

It is preferred that the M3 is more than 5000 (g·cm$^2$). In this case, the rotation about the third axis is less likely to occur so that the face surface undergoes less change in the orientation. Thus, the directionality of a hit ball may be further stabilized.

In one aspect of the present invention relating to a design method of a golf putter, there is provided a method of designing a golf putter, which defines a weight balance of the putter considering the correlation of magnitudes of the three moments of inertia about the principal inertial axes of the putter. This feature is described by way of the tennis racket theorem to be described below.

In another aspect of the present invention relating to the design method of a golf putter, there is provided a method of designing a golf putter, which considers the correlation of magnitudes of three moments of inertia M1, M2, and M3 (g·cm$^2$) defined by the following descriptions (1) to (3) and a value of (M1−M2), (1) M1: a moment of inertia of the putter about a first axis through a reference point P, parallel to a face surface and perpendicular to a shaft axis, the reference point P defined by an intersection of the shaft axis and a perpendicular line from a putter-supporting point on the shaft to the shaft axis in a static balance state of the one-point supported putter;

(2) M2: a moment of inertia of the putter about a second axis through the reference point P and perpendicular to the first axis and to the shaft axis; and (3) M3: a moment of inertia of the putter about a third axis defined by the shaft axis.

According to this design method, it is preferred to define the M1, the M2, and the M3 (g·cm$^2$) in a manner to provide a weight balance satisfying the following expressions (A) and (B):

$$(M1-M2)<12000 \quad \text{(A)}$$

$$M1>M2>M3 \quad \text{(B)}.$$

It is noted that in a case where the face surface of the head is not flat, the "face surface" in the definition of the M1 is rewritten as "a plane passing through three points in total, which include two points at opposite ends of a ridge of a leading edge, and one point bisecting a ridge defining a boundary between a top surface and the face surface of the head".

As to a shaft the whole body of which is not extended straight but is partially bent, the aforesaid "shaft axis" is defined to mean "a shaft axis through a portion on which the grip is assembled".

DESCRIPTION OF THE PREFERRED EMBODIMENTS

Figure 1:
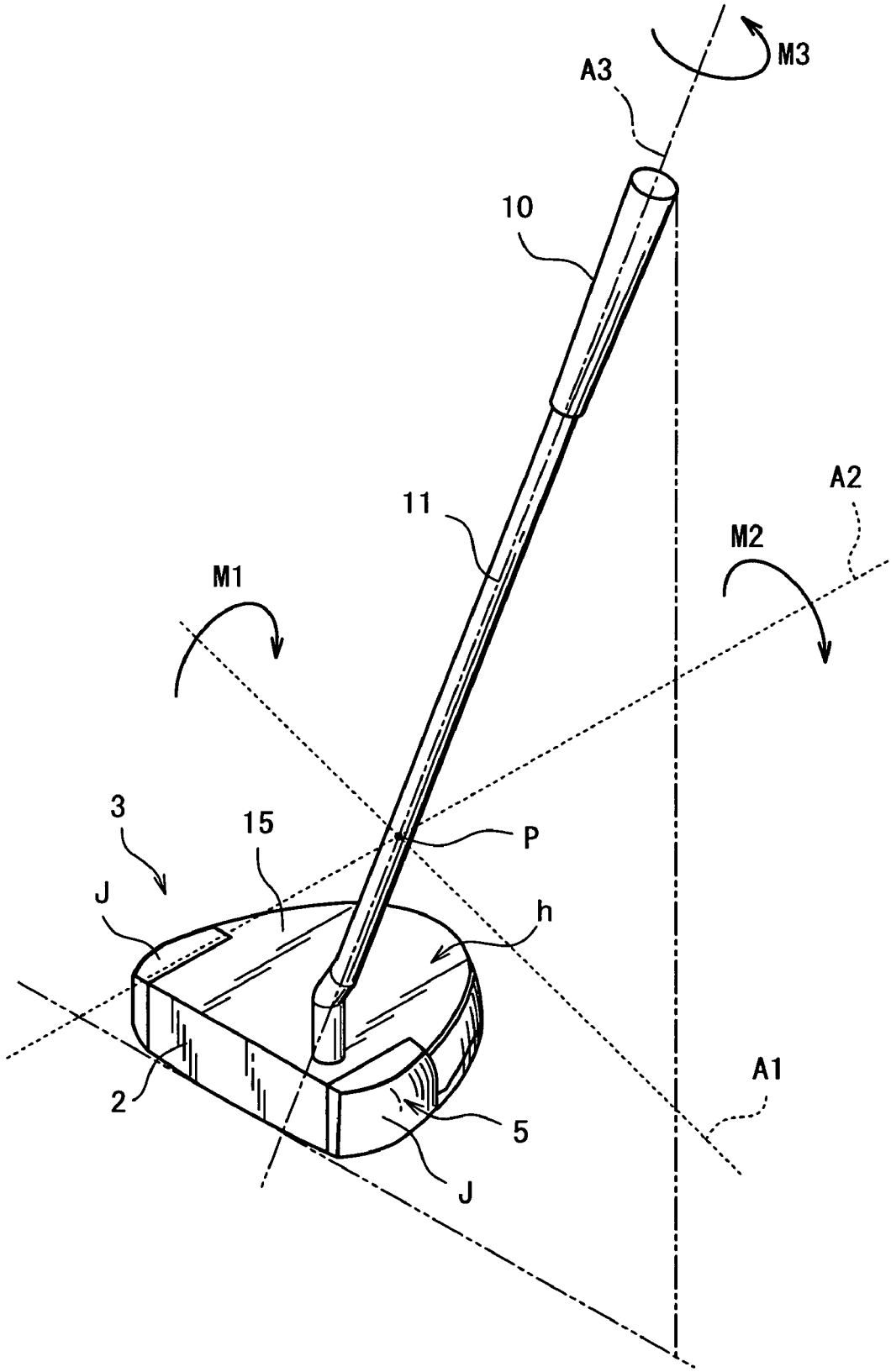
FIG. 1 is a perspective view of a golf putter according to one embodiment of the present invention.
Figure 2:
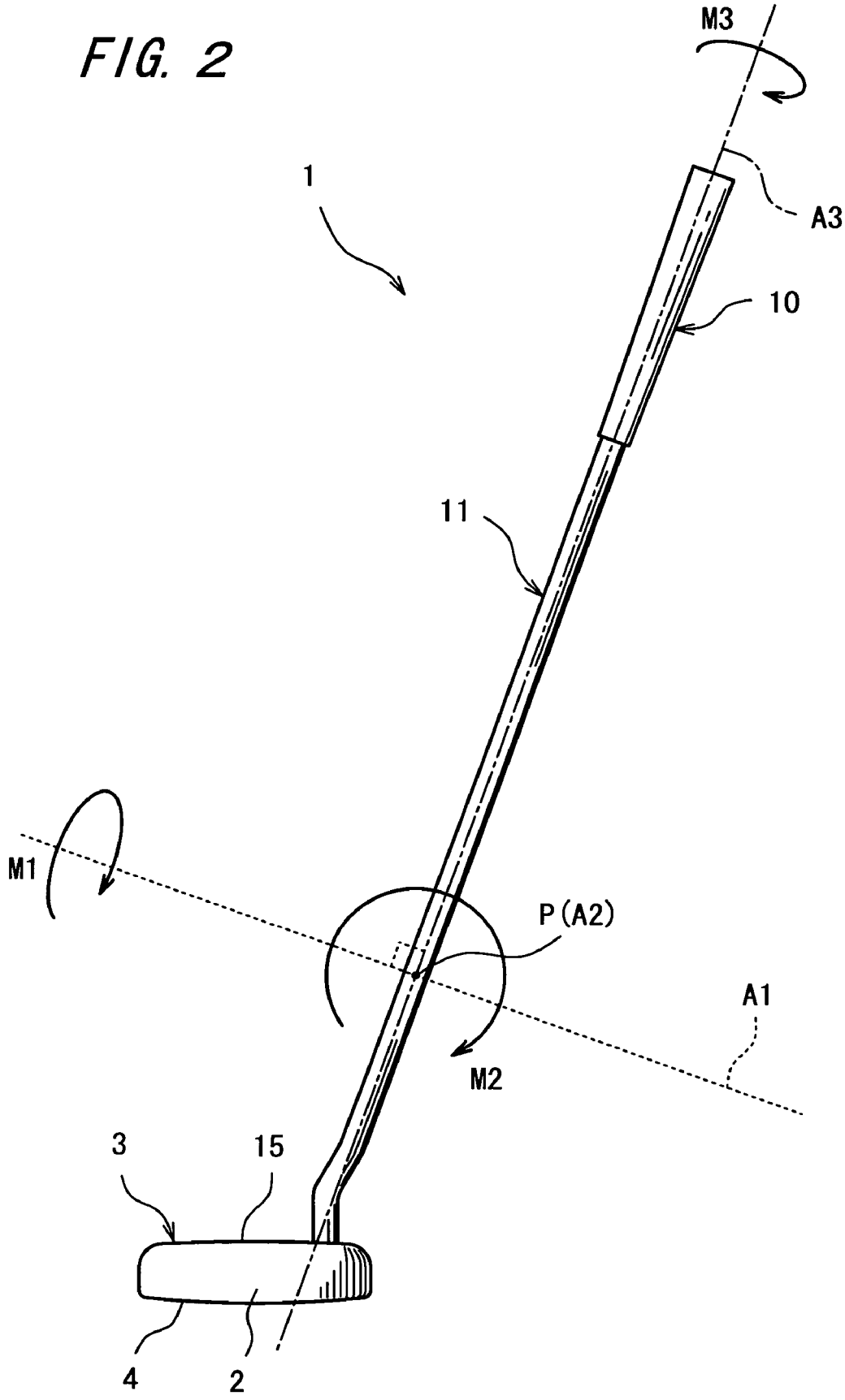
FIG. 2 is a front view of the golf putter of FIG. 1 as viewed from a face surface side.

The preferred embodiments of the present invention will be described with reference to the accompanying drawings. FIG. 1 is a perspective view of a golf putter 1 according to one embodiment of the present invention. FIG. 2 is a front view of the golf putter 1 as viewed from a face surface side. The golf putter 1 includes: a head 3 including a face surface 2 for hitting a ball; a grip 10 as a portion at which a player holds the golf putter 1; and a shaft 11 substantially shaped like a rod. The shaft 11 is assembled with the head 3 at one end thereof, and with the grip 10 at the other end thereof. The most part of the shaft 11 is shaped like a straight rod. However, the shaft is bent only at a portion near the end assembled with the head 3. While this portion is provided in order to set a proper lie angle, or the like of the golf putter 1, a detailed description thereof will be made below.

Figure 3A:
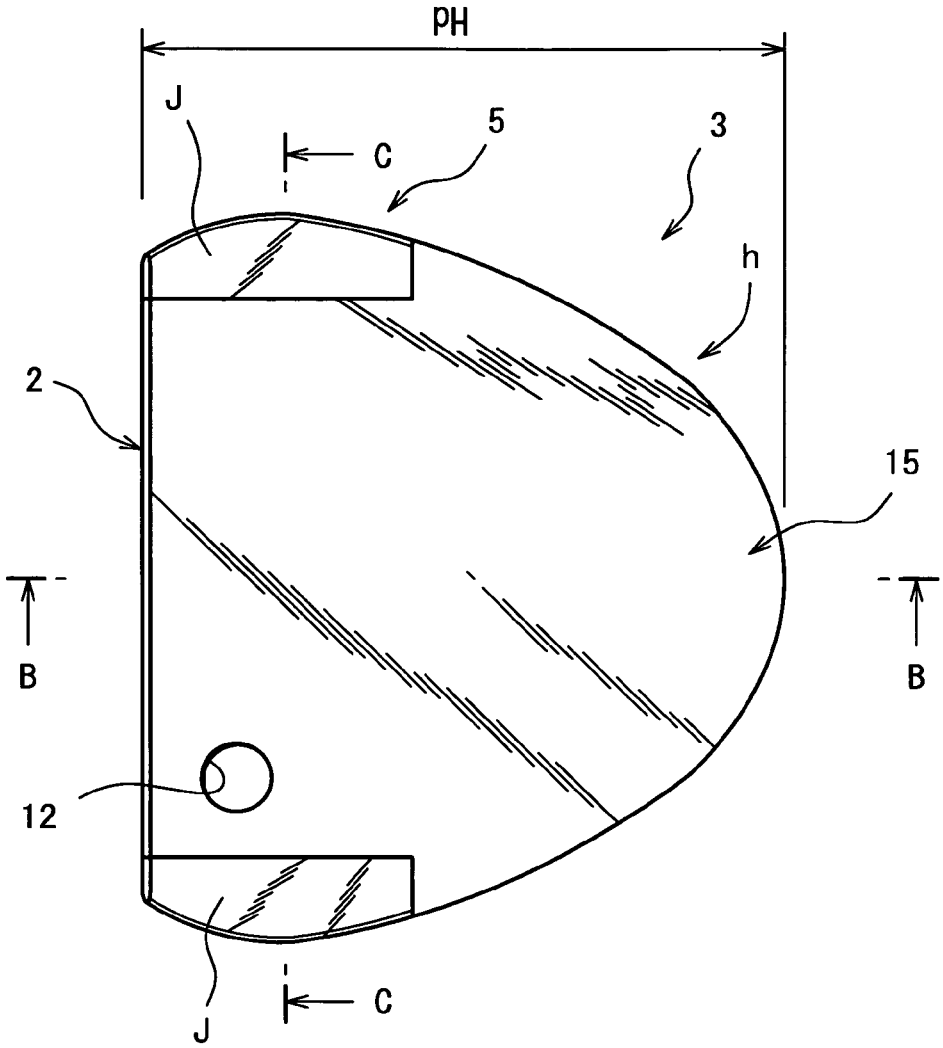
FIG. 3A is a plan view of a putter head used in the putter of FIG. 1, as viewed from a top surface side.
Figure 3B:
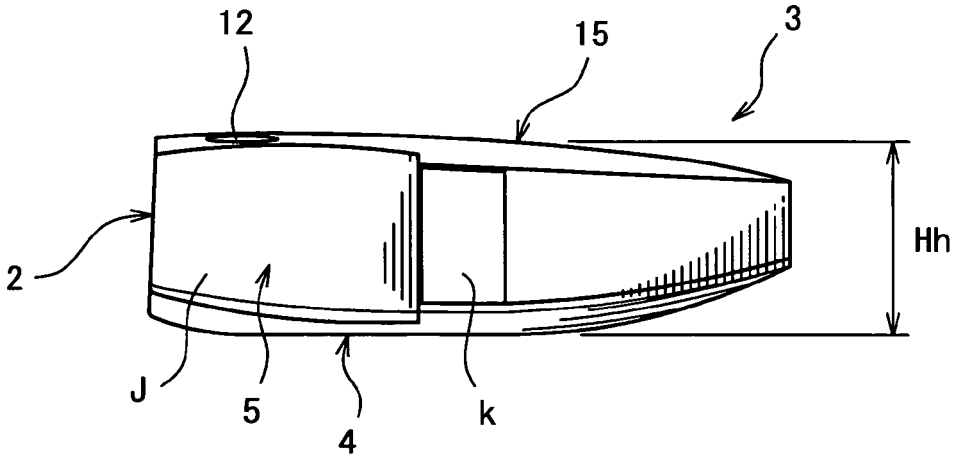
FIG. 3B is a side view of the putter head as viewed from a heel side.
Figure 4A:
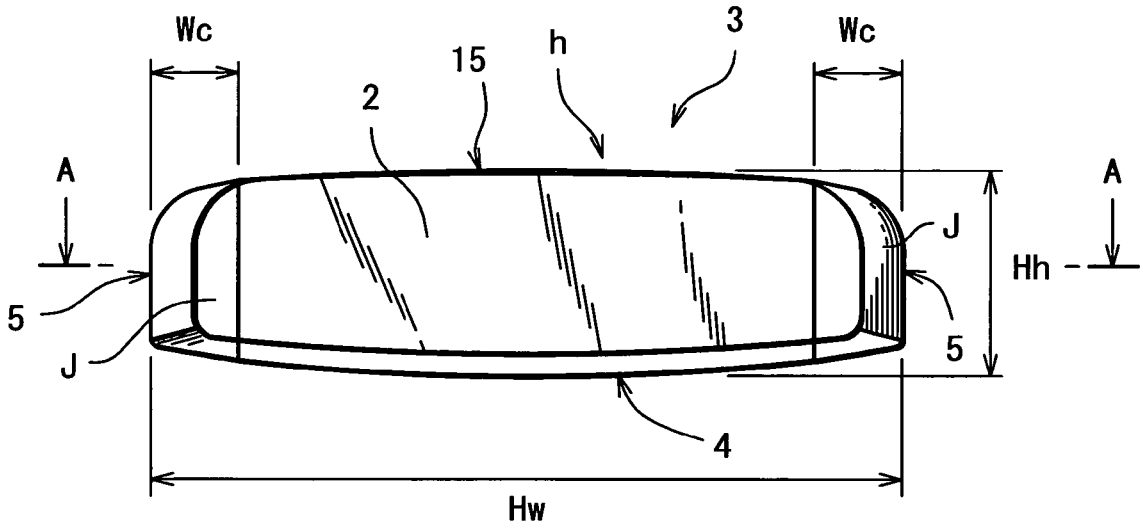
FIG. 4A is a front view of the putter head used in the putter of FIG. 1, as viewed from the face surface side.
Figure 4B:
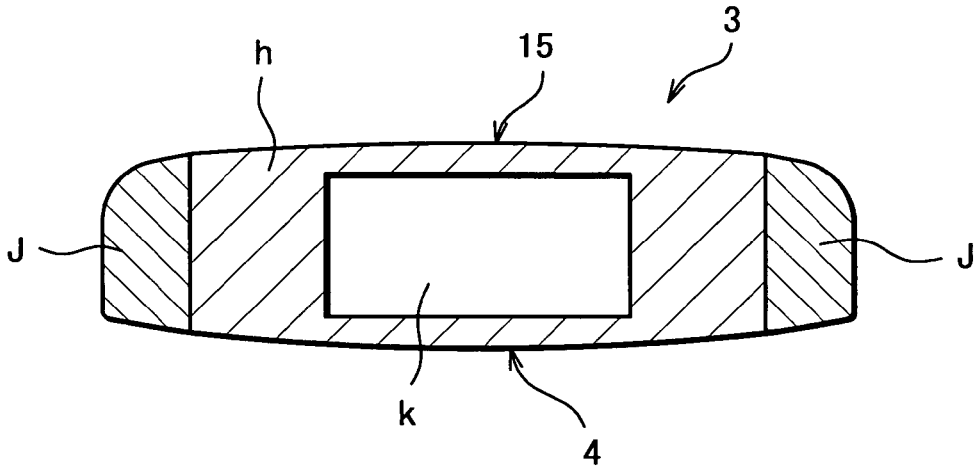
FIG. 4B is a sectional view taken on the line C-C in FIG. 3A.
Figure 5A:
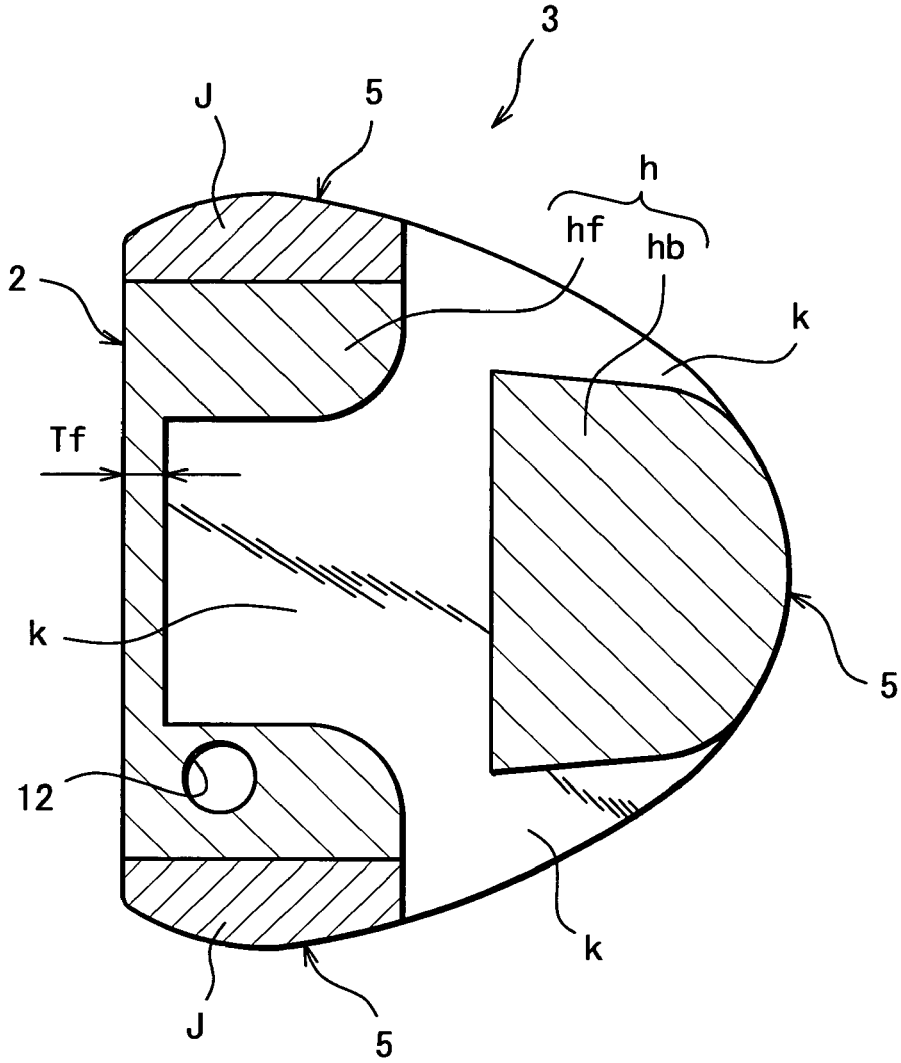
FIG. 5A is a sectional view taken on the line A-A in FIG. 4A.
Figure 5B:
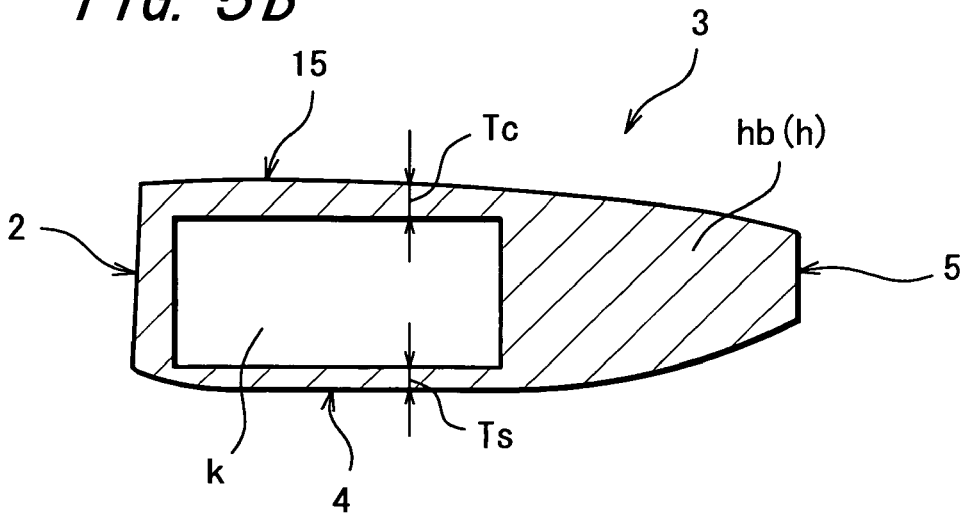
FIG. 5B is a sectional view taken on the line B-B in FIG. 3A.

FIG. 3A is a plan view of the head 3 as viewed from a top surface side 15, whereas FIG. 3B is a side view of the head 3 as viewed from a heel side. FIG. 4A is a front view of the head 3 as viewed from the face surface side 2, whereas FIG. 4B is a sectional view taken on the line C-C in FIG. 3A. FIG. 5A is a sectional view of the head 3 taken on the line A-A in FIG. 4A, whereas FIG. 5B is a sectional view of the head 3 taken on the line B-B in FIG. 3A.

The head 3 includes: the top surface 15 defining an upper surface thereof; a sole surface 4 defining a bottom surface thereof; a side surface 5 extending between the sole surface 4 and the top surface 15; and the face surface 2 defined by a flat surface for hitting a ball. The top surface 15 and the sole surface 4 have a substantially semi-circular contour, as shown in FIG. 3A.

The head 3 is free from a hosel hole (neck portion) and has the shaft 11 bonded thereto via a shaft hole 12. Specifically, the head 3 is formed with the shaft hole 12 at a heel side portion thereof The shaft 11 is inserted in the shaft hole 12 and an inner peripheral surface of the shaft hole 12 is bonded to an outside surface of the shaft 11. An axis of the shaft hole 12 is directed substantially perpendicular to the sole surface 4. Therefore, if a straight shaft 11 is inserted in the shaft hole 12, the golf putter 1 has a lie angle of about 90°, which is not a common lie angle of the putter. Hence, the shaft 11 is properly bent at the portion near the one end thereof, as described above, whereby the lie angle of the golf putter 1, a real loft angle, face progression, and the like are set to proper values.

The head 3 includes a head body h formed from an aluminum alloy, or the like; and a weight member J partially disposed on each of the toe side and the heel side of the head body h. Although not specifically shown in the figure, the weight member J and the head body h are fitted with each other by a suitable method such as press-fit.

Furthermore, the head 3 includes a cavity k therein. The head body h of the head 3 accounts for the overall top-side and sole-side areas of the head 3 except for the weight members J, thus constituting the most parts of the top surface 15 and the sole surface 4. Within the head 3, as shown in the sectional views of FIG. 5A and FIG. 5B, the head body is divided into a face-side portion hf located substantially at the face surface 2, and a back-side portion hb located substantially at a back side of the head. Thus, the cavity k exists between the face-side portion hf and the back-side portion hb. That is, the cavity k is a space defined between the top surface 15 and the sole surface 4 substantially in opposing relation and excluding the face-side portion hf and the back-side portion hb.

As shown in FIG. 5A, the face-side portion hf and the back-side portion hb are spaced away from each other with respect to a face-back direction of the head 3. Therefore, a part of the cavity k constitutes a penetration portion penetrating from the toe side to the heel side of the head 3, as shown in the sectional view of FIG. 3B.

As shown in FIG. 5A, a contour of the back-side portion hb substantially coincides with the contour of the head 3 at the rearmost part of the head 3 (a portion near a back-side apex of the head). Except for the portion near the back-side apex, however, the contour of the back-side portion hb does not coincide with that of the head 3. That is, the back-side portion hb is contoured inwardly from the contour of the head 3, so that the cavity k also exists on a toe side and a heel side of the back-side portion hb.

As shown in FIG. 5A, the face-side portion hf has a configuration wherein its volume (weight) is concentrated on a toe-side portion and a heel-side portion thereof whereas an intermediate portion thereof with respect to a toe-heel direction is shaped like a relatively thin plate. As shown in FIG. 5A and FIG. 5B, therefore, the cavity k accounts for a particularly large space around the center of the head 3 with respect to the toe-heel direction.

Such a face-side portion hf has the weight members J bonded with the toe side and the heel side thereof. The weight member J itself is a solid member formed from a material having a greater specific gravity than the head body h (such as copper, zinc, brass, tungsten, and alloys based on these metals). A top surface and a bottom surface of the weight member J are smoothly continuous to the top surface and the bottom surface of the head body h, thus constituting a part of the top surface 15 and of the sole surface 4, respectively. A side surface of the weight member J constitutes a part of the side surface 5.

The side surface 5 is defined by a surface portion extending between a circumference of the top surface 15 and a circumference of the sole surface 4 but excluding the face surface 2. In this head 3, the side surface 5 is constituted by only the side surfaces of the weight members J and a side surface portion of the back-side portion hb that extends in the vicinity of the back-side apex thereof. That is, the other parts of the head are free from the side surface 5, because the cavity k within the head is open toward the outside, as described above. In this manner, the head is provided with the cavity k therein, which divides the interior of the head body h into the back-side portion hb and the face-side portion hf, whereby the degree of freedom in designing the weight distribution of the head 3 is notably increased.

Figure 13:
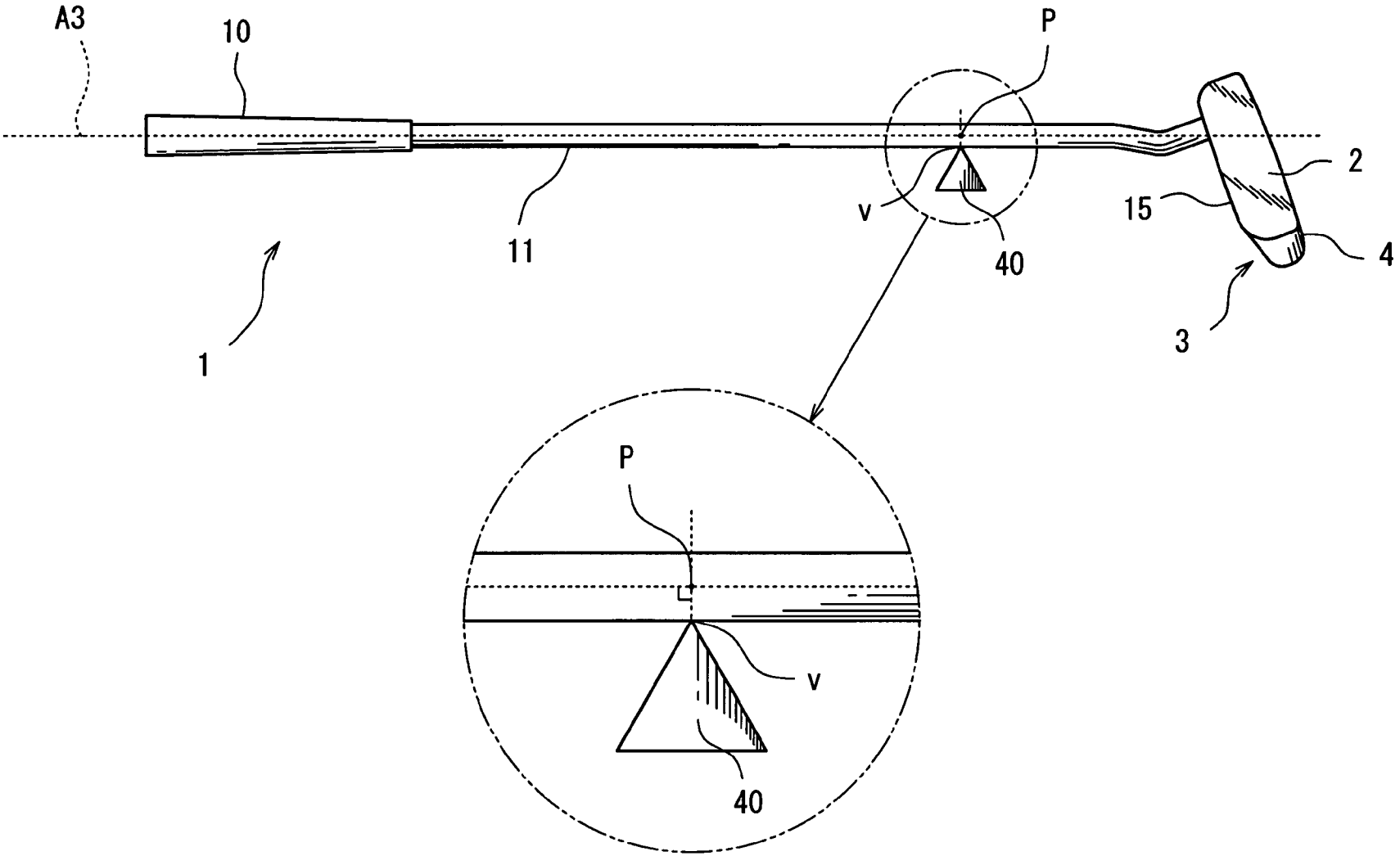
FIG. 13 is a diagram for explaining about a reference point P.

Here, the three axes of the golf putter 1 or the first axis A1 to the third axis A3, as shown in FIG. 1 and FIG. 2, are defined. In making the definition, the reference point P is first defined, which is an intersection of the three axes A1 to A3. FIG. 13 is a diagram showing the golf putter 1 in a balanced state where the shaft 11 is held stationary substantially in a horizontal position, as one-point supported by a support 40. As shown in FIG. 13, the reference point P is an intersection of the third axis A3 as a shaft axis and a perpendicular line from a putter-supporting point v to the shaft axis, the supporting point v on which the shaft 11 is one-point supported to be held in static balance (see an enlarged view in FIG. 13). As described above, the shaft 11 according to the embodiment is bent in the vicinity of its end at the head 3. The shaft axis or the third axis A3 in this case is defined to mean an axis of a portion of the shaft 11 of a portion to which the grip 10 is assembled.

The first axis A1 is an axis through the reference point P, parallel to the face surface 2 and perpendicular to the shaft axis. The second axis A2 is an axis through the reference point P and perpendicular to the first axis A1 and to the shaft axis. The third axis A3 is the shaft axis. A moment of inertia of the golf putter 1 about the first axis A1 is defined as a first moment M1 ($g\cdot cm^2$). A moment of inertia of the golf putter 1 about the second axis A2 is defined as a second moment M2 ($g\cdot cm^2$). A moment of inertia of the golf putter 1 about the third axis A3 is defined as a third moment M3 ($g\cdot cm^2$).

In the golf putter 1 according to the embodiment, these moments M1 to M3 (the unit of which is $g\cdot cm^2$) are defined in a manner to provide a weight balance satisfying the following relational expressions (A) and (B):

$$(M1-M2)<12000 \quad (A)$$

$$M1>M2>M3 \quad (B)$$

In addition, the third moment M3 is defined to be more than 5000 ($g\cdot cm^2$).

The golf putter 1 configured as described above has the following working effects.

The moments are related as M1>M2>M3. Therefore, if this relation is interpreted by way of the tennis racket theorem, rotation about the first axis A1 as a rotational axis of the first moment M1 and rotation about the third axis A3 as a rotational axis of the third moment M3 are relatively stable, whereas rotation about the second axis A2 as a rotational axis of the second moment M2 is relatively instable. In a behavior of the golf putter 1 during a putting stroke, the rotations about the first axis A1 and about the third axis A3 are relatively great, whereas the rotation about the second axis A2 is relatively small. Therefore, the rotations about the first axis A1 and the third axis A3 relatively great in rotational quantity may be stabilized by establishing the relation M1>M2>M3 as described above, whereby the putting stroke (swing) may be stabilized. On the other hand, the third moment M3 is defined to be more than 5000 ($g\cdot cm^2$) and hence, the rotation about the third axis A3 is less likely to occur so that the orientation of the face surface 2 is stabilized. This results in an enhanced directionality of hit ball.

Next, description is made on the theoretical grounds of the present invention. The following description relating to Euler's equations of motion (Euler's theorem) is described in "Classical Mechanics—A modem Perspective" (by V. D. Berger and M. G. Olsson, translated by Morikazu Toda and Yukiko Taue, first printing of first edition; Jan. 20, 1975, 17$^{th}$ printing of first edition; Nov. 30, 1987) published by Baifukan Co., Ltd. Where Euler's equations for a rigid body having three different main moments of inertia are used, the following results are obtained in the motions about the respective axes. In the axis x, axis y, and axis z, which are three mutually perpendicular principal axes of inertia, the values of the moments of inertia (main moments of inertia) about the respective axes are designated as $I_x$, $I_y$ and $I_z$. Furthermore, it is assumed that the inequality $I_x<I_y<I_z$ holds true. Since gravity is a uniform force in the vicinity of the surface of the earth, there is no moment of gravity about the center of gravity of a rigid body. If the moment of the force arising from wind pressure is ignored, then Euler's equations of motion are written as the following Equation (1):

$$I_x\dot{\omega}_x+(I_z-I_y)\omega_z\omega_y=0$$

$$I_y\dot{\omega}_y+(I_x-I_z)\omega_x\omega_z=0$$

$$I_z\dot{\omega}_z+(I_y-I_x)\omega_y\omega_x=0 \quad (1)$$

Here, $\omega_x$, $\omega_y$, $\omega_z$ are respectively the angular velocity vectors of the rotations about the axis x, axis y and axis z, whereas $\dot{\omega}_x$, $\dot{\omega}_y$, $\dot{\omega}_z$ are respectively the angular acceleration vectors of the rotations about the axis x, axis y and axis z.

Here, from the theorem of perpendicular axes, the following Equation (2) holds true.

$$I_z=I_x+I_y \quad (2)$$

If this relational Equation (2) is substituted into Equation (1), and r is set equal to $(I_y-I_x)/(I_y+I_x)$, then the following Equations (3) to (5) are obtained.

$$\dot{\omega}_x+\omega_z\omega_y=0 \quad (3)$$

$$\dot{\omega}_y-\omega_x\omega_z=0 \quad (4)$$

$$\dot{\omega}_z+r\omega_y\omega_x=0 \quad (5)$$

Here, assuming that $I_x$, which is the smallest of $I_x$, $I_y$ and $I_z$, is much smaller than $I_y$, then the approximation of $r\cong 1$ can be used. The qualitative motion properties on assumption that the rigid body initially rotates mainly about one of the three principal axes will be determined as below.

If the initial rotation is about the x axis, then $\omega_z\omega_y$ in Equation (3) can be ignored. Consequently, it is seen that $\omega_x$ is fixed. Specifically, $\omega_x$ is fixed at the initial value $\omega_x$ (0) as shown in the following Equation (6).

$$\omega_x=\omega_x(0) \quad (6)$$

The two remaining Equations (4) and (5) can be solved by introducing a complex variable as shown in the following Equation (7).

$$\overline{\omega}=\omega_z+\omega_y \tag{7}$$

Here, $\omega_y=\mathrm{Im}\overline{\omega}$, and $\omega_z=\mathrm{Re}\overline{\omega}$, where Im indicates the imaginary part and Re indicates the real part.

Accordingly, Equations (4) and (5) are rewritten as the following Equations (8) and (9), respectively. If these Equations (8) and (9) are combined to form a single equation for the complex variable of Equation (7), then Equation (10) holds true. The differential equation expressed by Equation (10) has an exponential function solution as shown by the following Equation (11).

$$\mathrm{Im}\dot{\overline{\omega}}-\omega_x\mathrm{Re}\overline{\omega}=0 \tag{8}$$

$$\mathrm{Re}\dot{\overline{\omega}}+\omega_x\mathrm{Im}\overline{\omega}=0 \tag{9}$$

$$\dot{\overline{\omega}}-i\omega_x\overline{\omega}=0 \tag{10}$$

$$\overline{\omega}(t)=a\cdot\exp\{i(\omega_x t+\alpha)\} \tag{11}$$

Accordingly, the corresponding $\omega_y$ and $\omega_z$ can be expressed as follows as functions of the time t:

$$\omega_y(t)=a\cdot\sin(\omega_x t+\alpha) \tag{12}$$

$$\omega_z(t)=a\cdot\cos(\omega_x t+\alpha) \tag{13}$$

Since the amplitude a is small according to the initial conditions, it is seen that the values of the two angular velocity components of Equations (12) and (13) are both consistently small. In the case of such an approximation solution, the following Equations (14) and (15) are obtained.

$$|\overline{\omega}|=\sqrt{\omega_y(t)^2+\omega_z(t)^2}=\alpha \tag{14}$$

$$\omega=\sqrt{\omega_x(t)^2+\omega_y(t)^2+\omega_z(t)^2}=\sqrt{\omega_x{}^2+\alpha^2} \tag{15}$$

Accordingly, the angular velocity vector ω shown in the following Equation (16) performs precession describing a small circular cone about the principal axis x. This is the reason that the rotational motion about the axis x is stabilized.

$$\omega=\omega_x\hat{1}+\omega_y\hat{J}+\omega_z\hat{k} \tag{16}$$

where $\hat{1}$ is a unit vector with a length of 1 that is parallel to the axis x, $\hat{J}$ is a unit vector with a length of 1 that is parallel to the axis y, and $\hat{k}$ is a unit vector with a length of 1 that is parallel to the axis z.

In the case of initial rotation mainly about the axis z, the solution of Euler's equations is similar to that of the case just treated. In a case where r=1, the mathematical structures of the respective Equations (3), (4) and (5) do not vary even if $\omega_x$ and $\omega_z$ are replaced. Accordingly, the approximate solutions (17) through (19) are obtained in accordance with Equations (6), (12) and (13).

$$\omega_z(t)=\omega_z(0) \tag{17}$$

$$\omega_x(t)=a\cdot\cos(\omega_z t+\alpha) \tag{18}$$

$$\omega_y(t)=a\cdot\sin(\omega_z t+\alpha) \tag{19}$$

In this case as well, the rotational motion about the axis is stable.

However, in a case where the initial rotation is performed about the principal inertial axis y, the conditions are different. In this case, $\omega_x\omega_z$ in Equation (4) is first ignored, and the following equation is obtained.

$$\omega_y(t)=\omega_y(0) \tag{20}$$

Next, if a sum and difference are created from Equations (3) and (5), the following Equations (21) and (22) are obtained, respectively. The first-order coupled solutions of these equations are as shown in Equations (23) and (24). If $\omega_x$ and $\omega_z$ are determined by solving these Equations (23) and (24), then Equations (25) and (26) are obtained.

$$(\dot{\omega}_x+\dot{\omega}_z)+\omega_y(\omega_x+\omega_z)=0 \tag{21}$$

$$(\dot{\omega}_x-\dot{\omega}_z)-\omega_y(\omega_x-\omega_z)=0 \tag{22}$$

$$(\omega_x+\omega_z)=a\cdot\exp(-\omega_y t \tag{23}$$

$$(\omega_x-\omega_z)=b\cdot\exp(+\omega_y t \tag{24}$$

$$\omega_x(t)=\tfrac{1}{2}\{a\cdot\exp(-\omega_y t)+b\cdot\exp(+\omega_y t)\} \tag{25}$$

$$\omega_z(t)=\tfrac{1}{2}\{a\cdot\exp(-\omega_y t)-b\cdot\exp(+\omega_y t)\} \tag{26}$$

In this motion, the angular velocities about the axis x and the axis z abruptly increase with time, so that an object as a rigid body is upset. Considered in a case where the rotated object is thrown up, the definite solutions derived from Equations (20), (25) and (26) are valid so long as much time has not passed from the upthrow of the object, i.e., so long as $\omega_x\omega_z$ can be ignored in Equation (4). Thus, the object behaves in a manner that out of the rotational motions about the three principal inertial axes, the rotational motion about the principal inertial axis exhibiting the maximum or minimum value of the moment of inertia moment about the axis is stable, whereas the other rotational motion about the principal inertial axis is instable.

Figure 15:
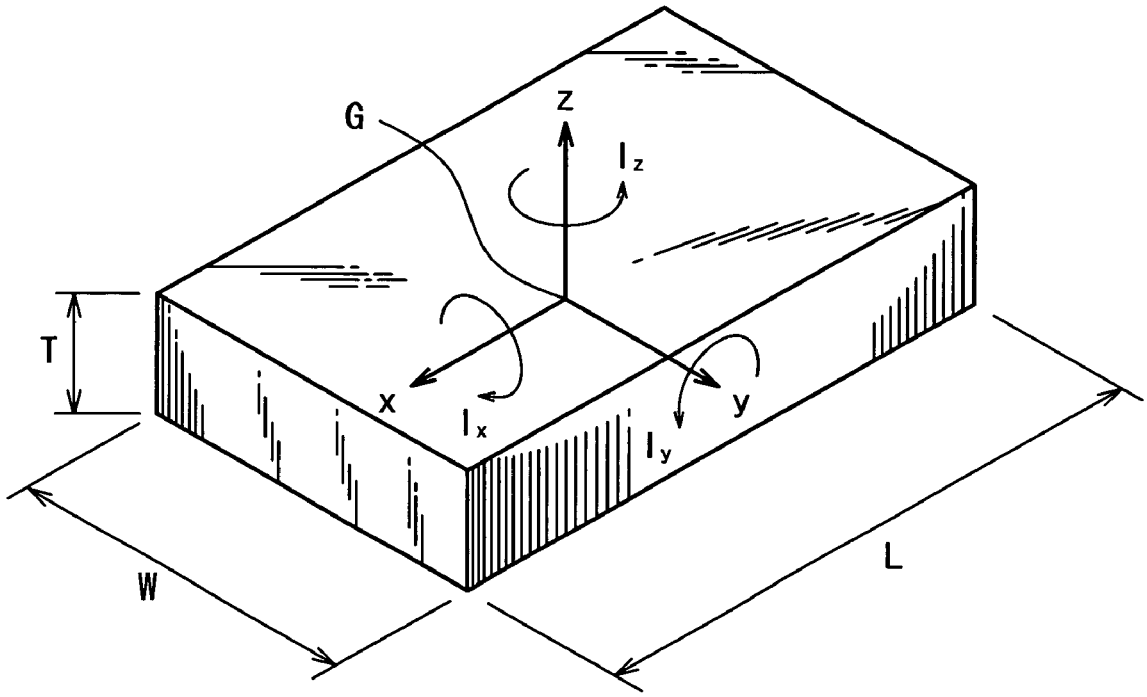
FIG. 15 is a diagram for explaining about the tennis racket theorem.

This conclusion may be explained as follows using a simple model. Let us consider a simple (solid) flat plate as a model which has a longitudinal length L, a width W and a thickness T, as shown in FIG. 15. In this model, the moments of inertia about the three principal axes of inertia include: a moment of inertia $I_x$ about the x axis passing through the center of gravity G of this flat plate and in parallel to the upper and lower surfaces of the flat plate and to the side surface on the longitudinal side; a moment of inertia $I_y$ about the y axis passing through the center of gravity G, in parallel to the upper and lower surfaces of the flat plate, and perpendicularly to the x axis; and a moment of inertia $I_z$ about the z axis passing through the center of gravity G perpendicularly to the upper and lower surfaces. As shown in FIG. 15, this flat plate is configured such that the longitudinal length L is greater than the width W and that the width W is greater than the thickness T. It is clear that this provides the correlation of magnitudes of the moments of inertia about the three principal axes of inertia as $I_z>I_y>I_x$. That is, $I_z$ is of the greatest value, $I_y$ is of the second greatest value and $I_x$ is of the smallest value.

It is seen from the above conclusion that in the case of rotation about the axis (of the three principal inertial axes) exhibiting the maximum or minimum moment of inertia, the object is so stable as to continue rotating. However, in the case of rotation about the axis (of the three principal inertial axes) not exhibiting the maximum or minimum moment of inertia, the object undergoes the rotations about all these three principal inertial axes, so that the rotation of the object becomes instable. The following is inferred by applying this conclusion to the above flat plate. Let us consider a case where this plate is thrown up in the air as rotated about any one of the three principal inertial axes or the x axis, y axis and z axis. If the initial rotation is about either the x axis or the z axis, the plate continues rotating in a stable manner. If the initial rotation is about the y axis, however, the rotational motion soon becomes disordered, so that the rotations about all the three principal inertial axes will occur.

Although the above document does not suggest that Euler's theorem is applicable to the golf putter, the inventors have found that the theorem can be applied to the golf putter. Here, the definition is made on the three mutually perpendicular axes with respect to the golf putter, the axes including the first axis A1, the second axis A2 and the third axis A3, as shown in FIG. 1. During a putting stroke, the golf putter 1 performs a translational motion and a rotational motion concurrently. Let us consider the rotational motion of the putter 1 during the stroke on the basis of rotations about the aforementioned three axes, the first axis A1 to the third axis A3. During the putting stroke, the putter 1 performs a substantial pendulum motion about a portion near the grip 10 as a fulcrum. The rotational motion of the golf putter 1 based on the substantial pendulum motion is principally composed of the rotation about the first axis A1. The human body is not so formed as to stroke a putt without varying the orientation of the face surface 2 and hence, the orientation of the face surface 2 varies during the stroke. The rotational motion of the golf putter 1 based on such a motion as to vary the orientation of the face surface 2 is principally composed of the rotation about the third axis A3. As compared with the rotations about the first axis A1 and the third axis A3, the rotation about the second axis A2 is generally small in quantity. Since FIG. 2 shows the golf putter as viewed along an extension of the second axis A2, the second axis A2 is depicted as a point superimposed on the reference point P. The rotation about the second axis A2 is principally caused by a big upswing of the golf putter 1. During the putting stroke, however, the putter does not undergo a big swing like a full shot of a wood club, an iron club, or the like. Hence, the rotation about the second axis A2 is relatively small in quantity.

With respect to the rotational motion of the golf putter 1 during the putting stroke, therefore, the rotations about the first axis A1 and the third axis A3 having relatively great quantities of rotation may be stabilized in preference to the rotation about the second axis A2 having a relatively small quantity of rotation, thereby ensuring the stable rotational motion of the golf putter 1. The stable rotational motion of the putter leads to a stable putting stroke. Accordingly, the present invention applies the aforesaid tennis racket theorem to the golf putter, so as to define the relation M1>M2>M3, and to define M1 to be at the maximum value and M3 to be at the minimum value. In this manner, the present invention accomplishes the stabilization of the rotation about the first axis A1 and the rotation about the third axis A3.

In the golf putter 1 according to the embodiment, the center of gravity of the head 3 is not on the shaft axis, whereas the reference point P does not coincide with the center of gravity of the golf putter 1. Furthermore, the three axes, i.e., the first axis A1, the second axis A2 and the third axis A3 of the golf putter 1 are not in perfect coincidence with the principal inertial axes of the golf putter 1. However, the reference point P is located in the vicinity of the center of gravity of the putter 1. Also given the overall configuration of the longitudinally elongated golf putter 1, the three principal inertial axes of the golf putter 1 are substantially located similarly to the first axis A1 to the third axis A3 mentioned above. It may therefore be concluded that Euler's equations and the tennis racket theorem can be roughly applied to the above M1 to M3. Furthermore, such reasoning explains the results of tests conducted in the following examples to be described hereinafter.

In order to examine how the above M1 to M3 affect the rotational motion of the golf putter 1, computation (simulation) was conducted using a model wherein the three principal moments of inertia were set to predetermined numerical values.

On assumption that moments of inertia (principal moments of inertia) about three mutually perpendicular principal inertial axes sx, sy, sz are designated as s1, s2, s3, respectively (provided that s1>s2>s3), simulating Model A to Model E were prepared. In each of the models, the moments of inertia s1 to s3 were set to a predetermined numerical value, respectively. The set values of s1 to s3 ($g \cdot cm^2$) in each of the Models A to E are listed in the following Table 1.

TABLE 1

| | s1 ($g \cdot cm^2$) | s2 ($g \cdot cm^2$) | s3 ($g \cdot cm^2$) | s1 − s2 |
|---|---|---|---|---|
| Model A | 510000 | 490000 | 6000 | 20000 |
| Model B | 550000 | 490000 | 6000 | 60000 |
| Model C | 550000 | 450000 | 6000 | 100000 |
| Model D | 510000 | 450000 | 6000 | 60000 |
| Model E | 510000 | 490000 | 3000 | 20000 |

The above moments s1 to s3 are defined in accordance with M1 to M3 of the golf putter 1 respectively, whereas the above three principal inertial axes sx, sy, sz are defined in accordance with the first axis A1, the second axis A2, the third axis A3 of the golf putter 1, respectively. Therefore, s1 is set to a value relatively close to the first moment M1 of the golf putter 1. Likewise, s2 is set to a value relatively close to the second moment M2 of the golf putter 1, and s3 is set to a value relatively close to the third moment M3 of the golf putter 1. However, a value of (s1−s2), and a difference between the values of (s1−s2) in the individual models A to E are set to be somewhat greater. This is because the variations of the values are scaled up to emphasize the influence of the values (s1−s2) on the rotational motion.

Three kinds of initial conditions (initial values), or angular velocities at Time 0, were applied to each of the Models A to E. Then, how the angular velocities $\omega_{sx}$, $\omega_{sy}$, $\omega_{sz}$ about the axes sx, sy, sz vary with time were computed.

The three kinds of initial conditions are listed in the following Table 2.

TABLE 2

| | $\omega_{sx}$ (rad/s) | $\omega_{sy}$ (rad/s) | $\omega_{sz}$ (rad/s) |
|---|---|---|---|
| I.C. 1 | 0.87 | 0 | 0.5 |
| I.C. 2 | 0 | 0.1 | 0.5 |
| I.C. 3 | 0.87 | 0.1 | 0 |

Note:
I.C. means "initial condition".

These initial conditions 1 to 3 consider the angular velocities about the respective axes (the first axis A1, the second axis A2, the third axis A3) of the golf putter 1 at the start of a practical putting stroke. Specifically, each of 20 testers whose handicaps are 0 to 20 performed the putting stroke. Measurement was taken on the angular velocities about the first axis A1 to the third axis A3 immediately after the start of the stroke. Subsequently, the average of the respective sets of measurement values was determined. The average angular velocity of the rotation about the first axis A1 immediately after the start of the stroke was at 0.87. The average angular velocity of the rotation about the second axis A2 immediately after the start of the stroke was at 0.1. The average angular velocity of the rotation about the third axis A3 immediately after the start of the stroke was at 0.5. Therefore, these measurement values were directly used as the respective initial conditions $\omega_{sx}$, $\omega_{sy}$, $\omega_{sz}$.

As shown in Table 2, two of the three rotations $\omega_{sx}$, $\omega_{sy}$, $\omega_{sz}$ are imparted with the angular velocities in each of the initial conditions 1 to 3. This approach is taken to take the following fact into consideration. A stroke pattern differs from one golfer to another, so that there are some personal inconsistencies as to which of the rotations about the three axes A1 to A3 is relatively great in quantity. That is, there are defined three kinds of initial conditions each of which imparts the angular velocities to two of the three rotations $\omega_{sx}$, $\omega_{sy}$, $\omega_{sz}$, whereby a kind of comprehensive representation of the stroke patterns differing from one golfer to another can be achieved. Thus, the simulations are increased in accuracy.

Figure 16:
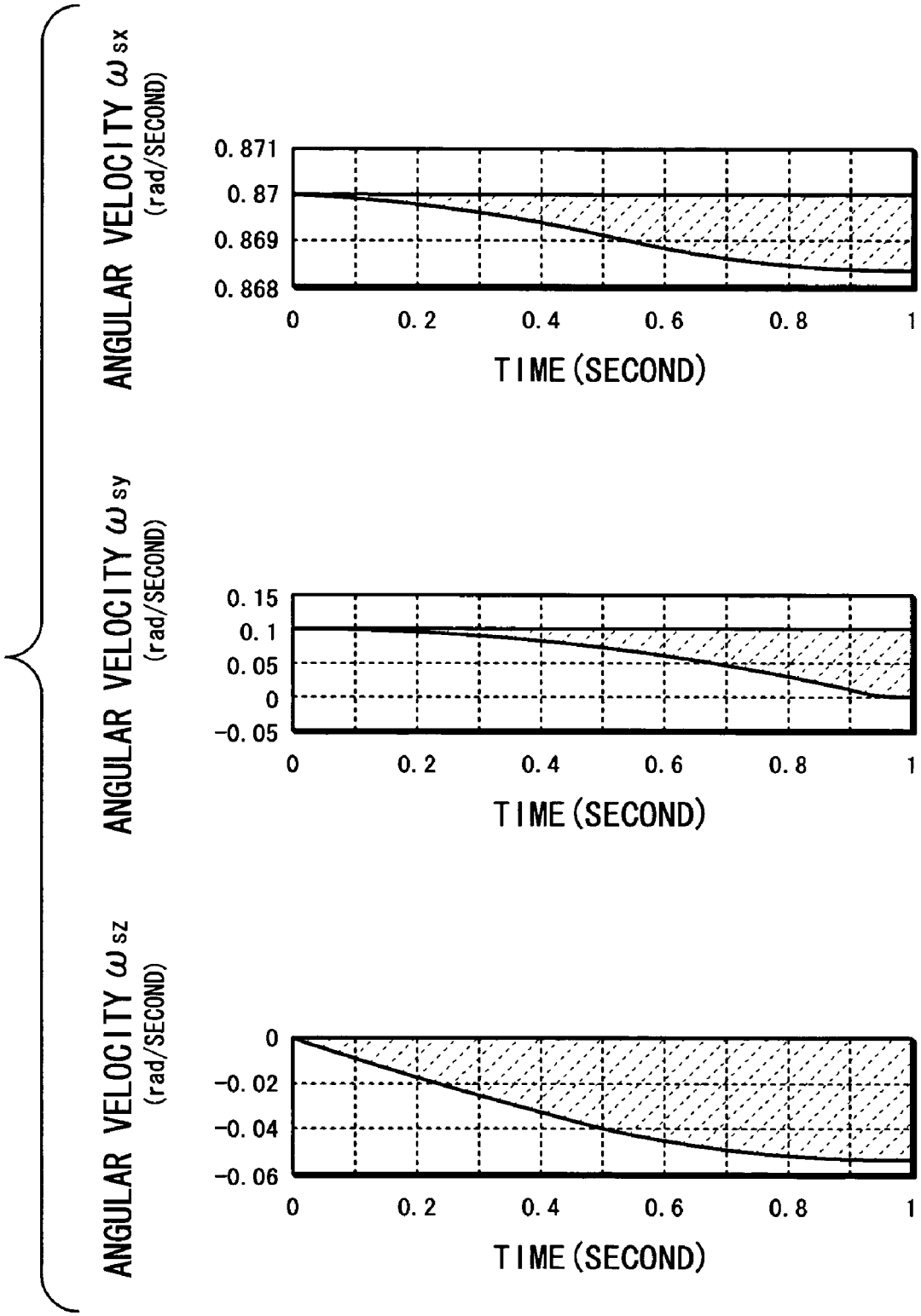
FIG. 16 is a group of graphs each showing a relation between calculated angular velocity and time.

Based on the Euler's equations of motion represented by the aforementioned equation (1), the set values of s1 to s3 listed in Table 1 and the initial conditions (initial values) listed in Table 2, the angular velocities $\omega_{sx}$, $\omega_{sy}$, $\omega_{sz}$ were determined at individual times during the lapse of one second from Time 0. FIG. 16, for example, is a group of graphs respectively plotting the angular velocities $\omega_{sx}$, $\omega_{sy}$, $\omega_{sz}$ at the individual times in a case where the initial condition 3 is applied to the Model A out of the Models A to E listed in Table 1. As shown in the graphs of FIG. 16, the angular velocities at Time 0 are given based on the initial condition. However, the angular velocities $\omega_{sx}$, $\omega_{sy}$, $\omega_{sz}$ individually vary with time. In the graph plotting the angular velocities against the time axis, the angular velocities are integrated based on time so as to determine an area of a hatched portion in FIG. 16. Thus was obtained the angular influence quantity (rad) with respect to each of the rotations about the axes sx to sz during the laps of one second from Time 0. It is noted here that the angular influence quantity represents a difference between the angular change quantity of a rotation at the fixed angular velocity of the initial condition during the lapse of one second from Time 0 and the angular change quantity during the lapse of one second from Time 0 as determined by integrating the angular velocities in the graph based on the above computation. Incidentally, the time period is defined to be one second in order to count in swing-back time in the putting stroke. The results are listed in the following Table 3.

TABLE 3

| Initial conditions | Model | Rad on rotation about sx | Rad on rotation about sy | Rad on rotation about sz |
|---|---|---|---|---|
| Initial condition 1 | Model A | −0.021 | −0.0178 | −0.185 |
| | Model B | −0.007 | −0.114 | −0.455 |
| | Model C | −0.003 | −0.060 | −0.587 |
| | Model D | −0.007 | −0.114 | −0.457 |
| | Model E | −0.013 | −0.143 | −0.329 |
| Initial condition 2 | Model A | 0.023 | −0.004 | 0.002 |
| | Model B | 0.022 | −0.004 | 0.007 |
| | Model C | 0.020 | −0.004 | 0.011 |
| | Model D | 0.021 | −0.004 | 0.007 |
| | Model E | 0.024 | −0.004 | 0.005 |

TABLE 3-continued

| Initial conditions | Model | Rad on rotation about sx | Rad on rotation about sy | Rad on rotation about sz |
|---|---|---|---|---|
| Initial condition 3 | Model A | 0.003 | −0.038 | 0.116 |
| | Model B | 0.002 | −0.092 | 0.203 |
| | Model C | 0.002 | −0.118 | 0.163 |
| | Model D | 0.002 | −0.092 | 0.202 |
| | Model E | 0.003 | −0.067 | 0.184 |

The absolute value of the angular influence quantity indicates how much the angular change quantity of the rotation during the lapse of one second from Time 0 differs from the angular change quantity of the rotation at the fixed angular velocity of the initial condition. In a case where the rotation at the fixed angular velocity is continued as maintaining the angular velocity of the initial condition, the rotational motion is stable. In a case where the above angular change quantity is produced, on the other hand, a rotational motion about one principal inertial axis causes a rotational motion about another principal inertial axis, thus resulting in complicated rotational motions including rotations about plural principal inertial axes. Accordingly, the rotational motion becomes instable. Hence, the greater the absolute value of the angular change quantity, the more instable is the rotational motion about the principal inertial axis.

Among the angular influence quantities with respect to the rotations about the axes shown in Table 3, the angular influence quantity with respect to the rotation about the axis sz, in particular, has the most significant relation with the stability of the putting stroke. This is because the axis sz corresponds to the third axis A3 of the golf putter 1, as described above. The rotation about the third axis A3 has such a great influence on the orientation of the face surface 2 as to directly affect the directionality of hit balls.

It is determined from the results shown in Table 3 that with the decrease of the value of (s1−s2), the model has the correspondingly smaller absolute value of the angular influence quantity on the rotation about the axis sz. According to comparison based on the initial condition 1, for example, the Model A having the smallest value of (s1−s2) among the five models presents the smallest absolute value of the angular influence quantity on the rotation about the axis sz. This also holds true for the initial condition 2 and the initial condition 3. In the case of the initial conditions 1 and 2, the Model C having the largest value of (s1−s2) among the five models presents the largest absolute value of the angular influence quantity on the rotation about the axis sz.

According to comparison among the Models A to D, the models present different angular influence quantities on the rotation about the axis sz although the models have the same moment of inertia s3 of 6000 ($g \cdot cm^2$). This suggests that the stability of the rotation about the axis sz (equivalent to the third axis A3 of the golf putter 1) is not fully ensured by merely considering the moment of inertia s3 (equivalent to the third moment M3 of the golf putter 1).

Next, the results of the Models A and E in Table 3 are compared. In each of the cases of the initial conditions 1 to 3, the Model A presents the smallest absolute values of the angular influence quantity on the rotation about the axis sz than the Model E. As shown in Table 1, the Model A differs from the Model E only in the value of s3, or the Model A has the larger value of s3 than the Model E. Therefore, the results of Table 3 indicate a tendency that the increase of the value s3 (equivalent to the third moment M3 of the golf putter 1) leads to the higher stability of the putting stroke.

It is concluded from the results of the simulations that the golf putter 1 is characterized in:

(a) that the putter is preferably premised on M1>M2>M3;

(b) that the smaller value of (M1−M2) is the more preferred; and (c) that the larger value of M3 is the more preferred. Also considering the results of the examples to be described below, the stability of the putting stroke is enhanced by satisfying the following expressions (A) and (B):

$$(M1-M2)<12000 \quad (A)$$

$$M1>M2>M3 \quad (B).$$

In addition, it is preferred that the value of the third moment M3 is more than 5000 (g·cm$^2$).

Figure 14:
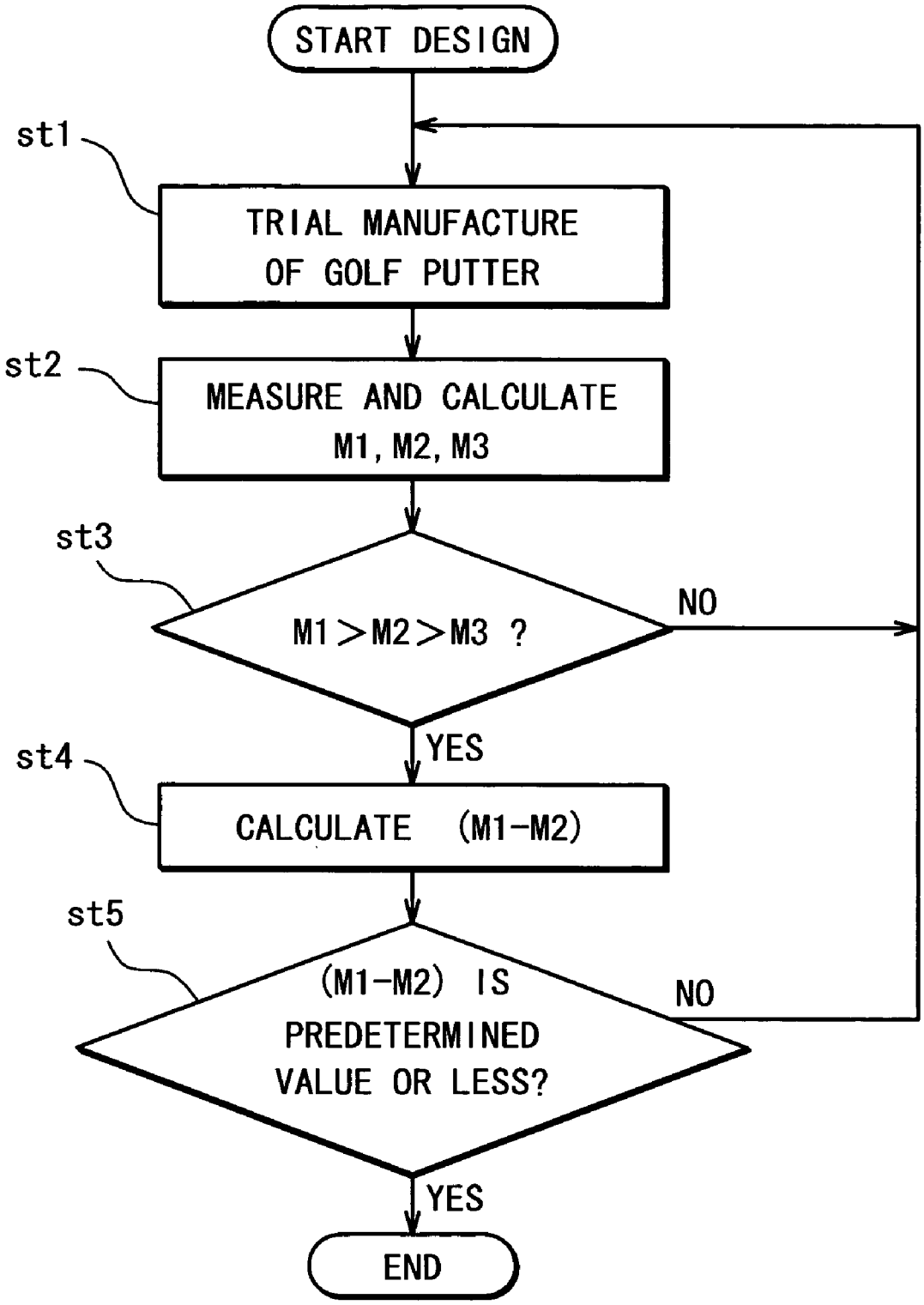
FIG. 14 is a flow chart showing the steps of a designing method according one embodiment of the present invention.

A designing method of the present invention is a design method for a golf putter which contemplates the correlation of magnitudes of the aforementioned three moments of inertia M1, M2, and M3 (g·cm$^2$) and the value of (M1−M2). As shown in the flow chart of FIG. 14, for example, the design method according to one embodiment of the present invention includes: Step st1 of manufacturing the golf putter by way of trial; Step st2 of determining (taking measurements) or computing M1 to M3; Step st3 of determining whether the values of M1 to M3 are in the order of M1>M2>M3; Step st4 of calculating the value of (M1−M2); and Step st5 of determining whether or not the value of (M1−M2) is a predetermined value or less. If the result of the determination at Step st3 or Step st5 is "NO", the operation flow returns to Step st1 of manufacturing the golf putter by way of trial. In this manner, the application of the tennis racket theorem is implemented by considering the correlation of magnitudes of M1 to M3, so that the moment of inertia about the axis, the stabilization of which is particularly desired, may be set to the maximum or minimum value. Furthermore, the value of (M1—M2) may be set to a relatively small value by contemplating the value of (M1−M2), such that the golf putter featuring a high stability of the putting stroke may be designed. In this case, more preferred is a design method which defines the moments of inertia M1 to M3 in a manner to provide a weight balance satisfying the following expressions (A) and (B):

$$(M1-M2)<12000 \quad (A)$$

$$M1>M2>M3 \quad (B)$$

Such a design method provides the golf putter ensuring the enhanced stability of the putting stroke as described above.

According to the above design method, a real golf putter may actually be manufactured by way of trial and evaluated. Otherwise, a three-dimensional model of the golf putter 1 may be produced on computer and simulated. In Step st1 of manufacturing the golf putter by way of trial, for example, the putter may actually be manufactured or may be produced as a three-dimensional model on computer. In Step st2 of determining the values of M1 to M3, measurements may actually be taken on M1 to M3. Alternatively, the values of M1 to M3 may be computed.

A different design method from the above is a method of designing a golf putter which defines a weight balance of the putter, considering the correlation of magnitudes of the three moments of inertia about the principal inertial axes of the putter 1. In the golf putter 1, there are three principal inertial axes (not shown) passing through the center of gravity (not shown) located in the vicinity of the aforesaid reference point P. These three principal inertial axes are located in a similar manner that the aforementioned first axis A1, second axis A2 and third axis A3 are located. If the aforementioned tennis racket theorem is applied, it is possible to stabilize a rotational motion abut a particular axis of the three principal inertial axes by defining the weight balance in consideration of the correlation of magnitudes of the three moments of inertia about these three principal inertial axes. In other words, the moment of inertia about an axis of the three principal inertial axes, the rotational motion about which axis is particularly desired to be stabilized, may be set to the maximum or minimum value, whereby the stabilization of the rotational motion about the axis may be achieved.

Let us consider a case where, fore example, the three principal inertial axes of the golf putter are designated as ks1, ks2, ks3 whereas the moments of inertia about the principal inertial axes are designated as km1, km2, km3. In a case where the stabilization of a rotation about the principal inertial axis ks1 is desired, for example, the moment of inertia km1 about the axis ks1 may be set to the greatest or smallest value of km1 to km3. In a case where the rotations about ks1 and ks3 of the three principal inertial axes are desired to be more stable than the rotation about ks2, for example, the weight balance of the putter may be so defined as to establish a relation of km1>km2>km3 or a relation of km3>km2>km1.

Assuming that out of the three principal inertial axes ks1 to ks3, the principal inertial axis located closest to the first axis A1 is designated as ks1, the principal inertial axis located closest to the second axis A2 is designated as ks2, and the principal inertial axis located closest to the third axis A3 is designated as ks3, it is preferred that the moment of inertia km1 about the principal inertial axis ks1, the moment of inertia km2 about the principal inertial axis ks2, and the moment of inertia km3 about the principal inertial axis ks3 are related as km1>km2>km3. The reason is the same as the reason for defining the relation as M1>M2>M3 in the aforementioned embodiment. In this case, the relatively smaller value of (km1−km2) is the more preferred as demonstrated by the aforementioned simulations. Hence, the value of(km1−km2) is preferably than 12000 (g·cm$^2$) or less, more preferably 11600 (g·cm$^2$) or less, even more preferably 6000 (g·cm$^2$) or less, and particularly preferably 3700 (g·cm$^2$) or less.

The moments of inertia km1, km2, km3 about the principal inertial axes may be determined by taking measurements on the putter. However, it is not always easy to set the putter in a measurement instrument for moment of inertia as positioning the putter to have its principal inertial axis aligned with a rotary axis of the measurement instrument. Therefore, it is preferred to compute the moments of inertia. For instance, a three-dimensional data on the golf putter 1 may be generated by way of CAD (Computer Aided Design) software, such that the moments of inertia km1 to km3 about the principal inertial axes ks1 to ks3 may be calculated based on the data so generated.

The golf putter of the present invention does not particularly limit the specifications of the head, the shaft and the grip or the materials thereof. Materials normally used for the golf putter head may be used as the material of the head. Examples of a usable material for the head body include brass, iron-based metals such as soft iron, stainless steel, aluminum alloys, titanium, titanium alloys, and the like. These materials may be used alone or in combination of plural types. In a case where the weight member J is used as described in the foregoing embodiment, examples of a usable material for the weight member J include copper, brass, tungsten, tungsten alloys such as W—Ni and W—Cu, and the like. In the case where the weight member J is used, it is preferred to form the head body h from aluminum or an aluminum alloy having a particularly small specific gravity because a difference from the specific gravity of the weight member J is increased so that the freedom of designing the weight distribution in the head 3 is increased. The shaft may employ any of the known shafts formed from steel and carbon (CFRP or the like). The grip may also employ any of the known grips formed of rubber, elastomer, leather, and the like.

In order to set the values of M1 to M3 or the correlation of magnitudes thereof according to desired specifications, proper adjustments may be made by arbitrarily setting the head weight, the position of the center of gravity of the head (the depth of the center of gravity, the distance to the center of gravity, the height of the center of gravity, and the like), the shaft weight, the position of the center of gravity of the shaft, the grip weight, the position of the center of gravity of the grip, the putter length, the lie angle, and the like, thereby achieving the desired specifications. For instance, the values of M1 and M2 may be increased by increasing the head weight and the grip weight so as to distribute the greater weights to the opposite ends of the putter. The values of M1 and M2 may also be increased by increasing the putter length. Furthermore, the value of M3 may be increased by increasing the distance to the center of gravity of the head or increasing the diameter of the grip or the shaft. It is also possible to increase the value of M2 without increasing the value of M1 by increasing the distance to the center of gravity of the head without varying the depth of the center of gravity of the head.

According to the present invention relating to the above golf putter and to the designing method thereof, the value of (M1–M2) is defined to be 12000 ($g \cdot cm^2$) or less. As described above, however, the smaller value of (M1–M2) is the more preferred and hence, the value thereof may preferably be 11600 ($g \cdot cm^2$) or less, more preferably 6000 ($g \cdot cm^2$) or less, and particularly preferably 3700 ($g \cdot cm^2$) or less. Since the greater value of the third moment M3 is the more preferred as described above, the value thereof may preferably be 5000 ($g \cdot cm^2$) or more, and more preferably 6100 ($g \cdot cm^2$) or more.

(Effects Confirmation by Examples)

In order to confirm the effects of the present invention, a test was conducted using four types of golf putters of Examples 1, 2 and Comparative Examples 1, 2. In all the examples and comparative examples (hereinafter, also referred to as all the examples), a head weight was 374 g, the total weight of the putter was 560 g, a putter length was 34 inches, and a lie angle was 70°. All the examples employed common grips and common shafts.

The test was conducted as follows. Practically, 30 golfers whose handicaps are 0 to 15 performed putting and organoleptically evaluated the stability of the putting stroke (swing). Each golfer evaluated each of the examples on two scales, or based on that the putting stroke (swing) is stable or that the putting stroke (swing) is instable. Then, the evaluations made by the 30 golfers were generalized to evaluate each of the examples on three scales of "Very good", "Good" and "Poor". The evaluation was based on the following criteria:

Very good: 25 or more testers feel that the putting stroke (swing) is stable;

Good: 20 or more testers feel that the putting stroke (swing) is stable;

Poor: 20 or more testers feel that the putting stroke (swing) is instable.

The specifications of each of the examples and the results of the evaluations are listed in the following Table 4.

TABLE 4

| | M1 ($g \cdot cm^2$) | M2 ($g \cdot cm^2$) | M3 ($g \cdot cm^2$) | M1 − M2 | Evaluation |
|---|---|---|---|---|---|
| Ex. 1 | 491760 | 488040 | 5489 | 3720 | Very good |
| Ex. 2 | 500580 | 489020 | 6057 | 11560 | Good |
| C. EX. 1 | 503520 | 487060 | 5942 | 16460 | Poor |
| C. Ex. 2 | 496860 | 484120 | 3517 | 12740 | Poor |

As indicated by the results of Table 4, the examples had higher evaluations than the comparative examples.

The details of the specifications of the head of each example are as follows. The heads of all the examples had the same configuration wherein a head height Hh was 27 mm, a head width Hw was 97 mm, and a head depth Hd was 85.5 mm. The weight member J was formed from copper, whereas the head body h was formed from an aluminum alloy.

Similarly to the foregoing embodiment, Example 1 had a mode shown in FIG. 3A, FIG. 3B, FIG. 4A, FIG. 4B, FIG. 5A and FIG 5B. Both the weight members J disposed on the toe side and on the heel side had a toe-heel width Wc of 12 mm. The thin portion near the center of the face surface had a thickness Tf of 5 mm (see FIG 5A). The head body h had a thickness Tc of 3 mm at the top side over the cavity k, and a thickness Ts of 3 mm at the sole side below the cavity k (see FIG. 5B).

Figure 6A:
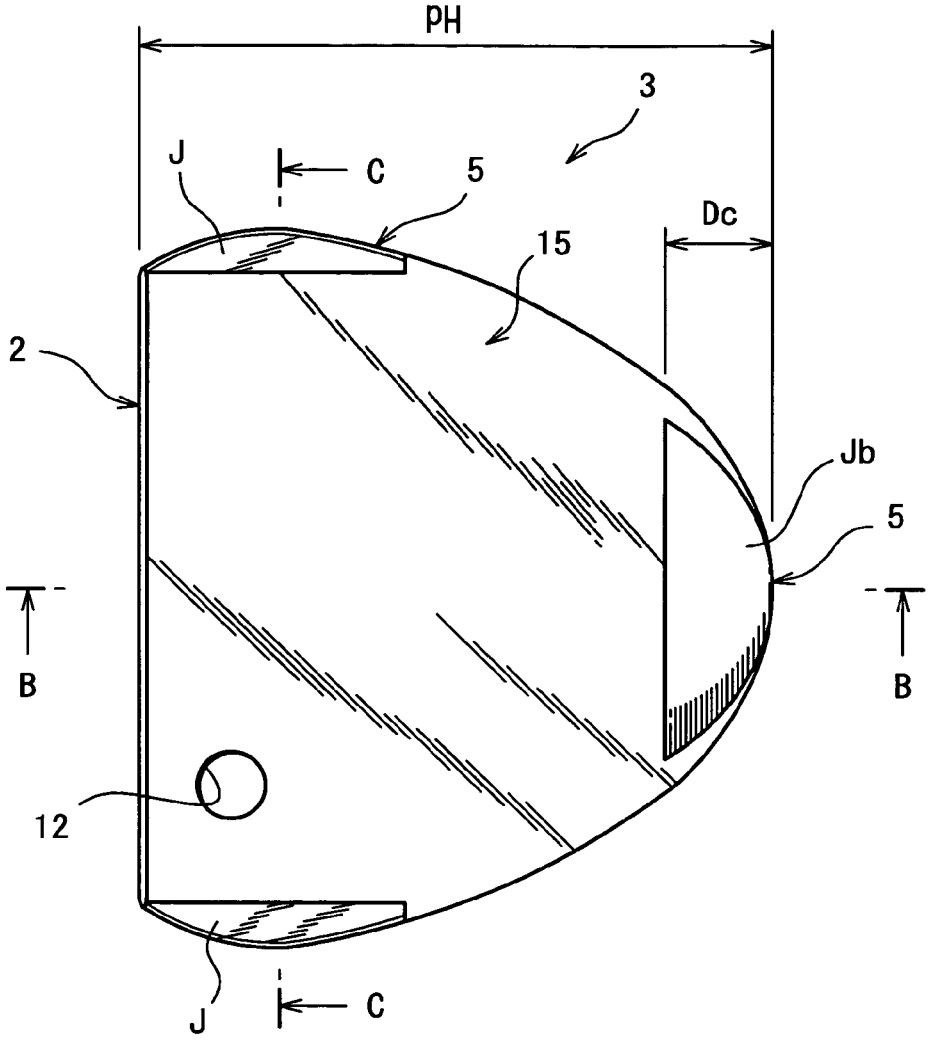
FIG. 6A is a plan view of a putter head as viewed from a top surface side, the putter head assembled to a golf putter of Example 2 hereof.
Figure 6B:
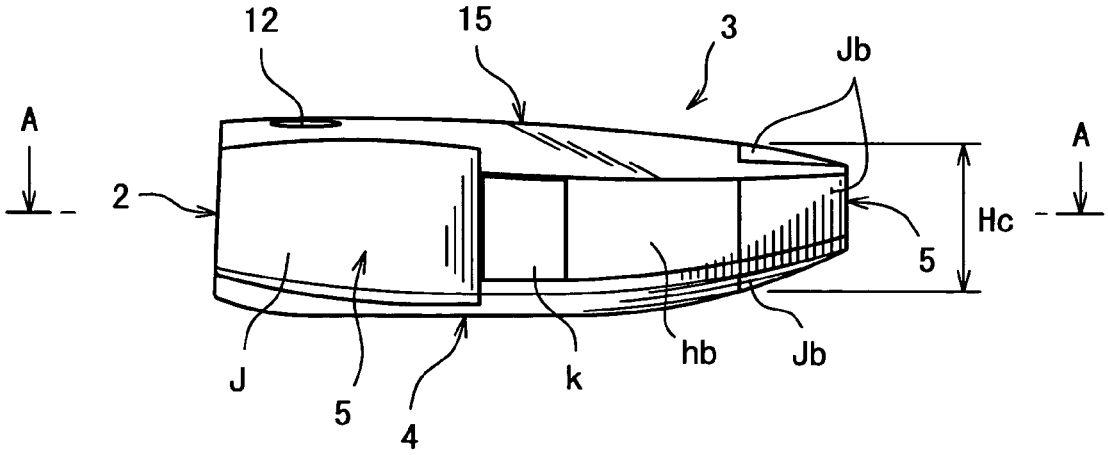
FIG. 6B is a side view of the putter head as viewed from the heel side, the head assembled to the golf putter of Example 2 hereof.
Figure 7A:
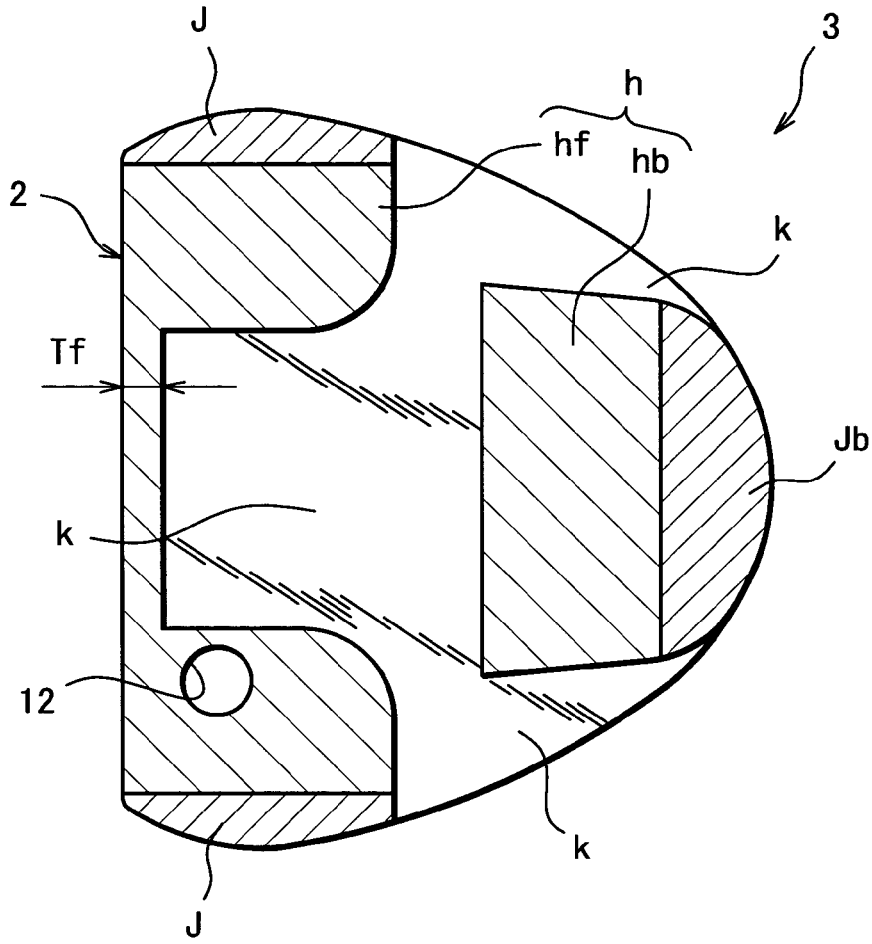
FIG. 7A is a sectional view taken on the line A-A in FIG. 6B.
Figure 7B:
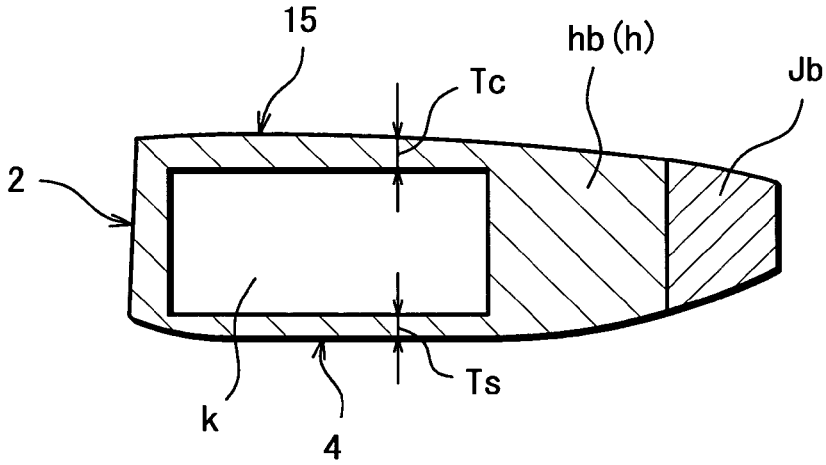
FIG. 7B is a sectional view taken on the line B-B in FIG. 6A.

A mode of Example 2 is shown in FIG. 6A, FIG. 6B, FIG. 7A and FIG. 7B. FIG. 6A is a plan view of Example 2 as viewed from the top surface side, whereas FIG. 6B is a side view thereof as viewed from the heel side. FIG. 7A is a sectional view taken on the line A-A in FIG. 6B, whereas FIG. 7B is a sectional view taken on the line B-B in FIG. 6A.

Example 2 is constructed basically the same way as Example 1, but differs from Example 1 in that the head body h is not only provided with the weight members J on the toe-side and the heel side of the face-side portion hf but is also provided with a back-side weight member Jb (formed from copper) on the back side of the back-side portion hb. In other words, a back-side part of the back-side portion hb of Example 1 is replaced by the back-side weight member Jb. The back-side weight member Jb has its top surface exposed on the top surface 15 of the head 3, thus constituting a part of the top surface 15. Furthermore, the back-side weight member Jb has its bottom surface exposed on the sole surface 4 of the head 3, thus constituting a part of the sole surface 4. The back-side weight member Jb has a maximum top-sole width Hc of 20 mm (see FIG. 6B) and a face-back width Dc of 14.5 mm (see FIG. 6A). The weight member has a width Wc of 7 mm, which is smaller than that of Example 1. The thicknesses Tf, Tc, Ts are the same as those of Example 1.

Figure 8A:
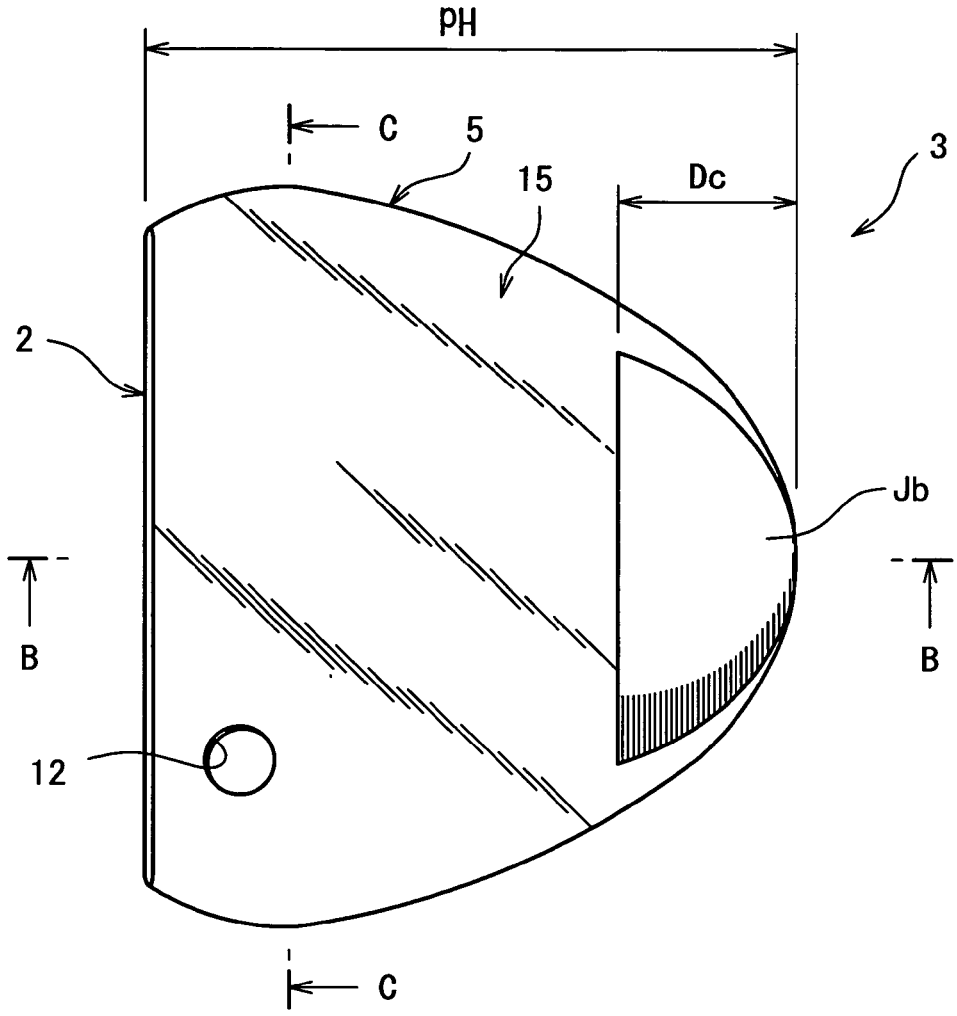
FIG. 8A is a plan view of Comparative Example 1 as viewed from the top surface side.
Figure 8B:
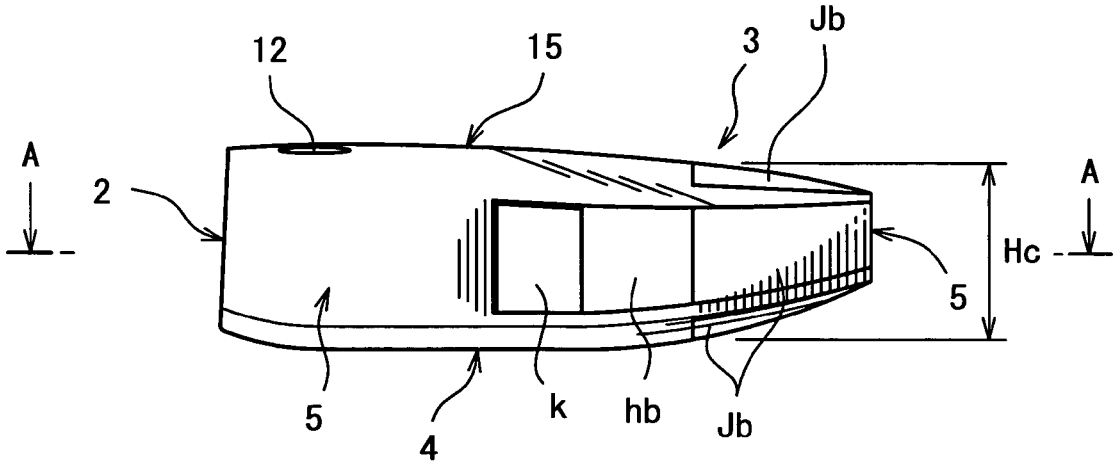
FIG. 8B is a side view of Comparative Example 1 as viewed from the heel side.
Figure 9A:
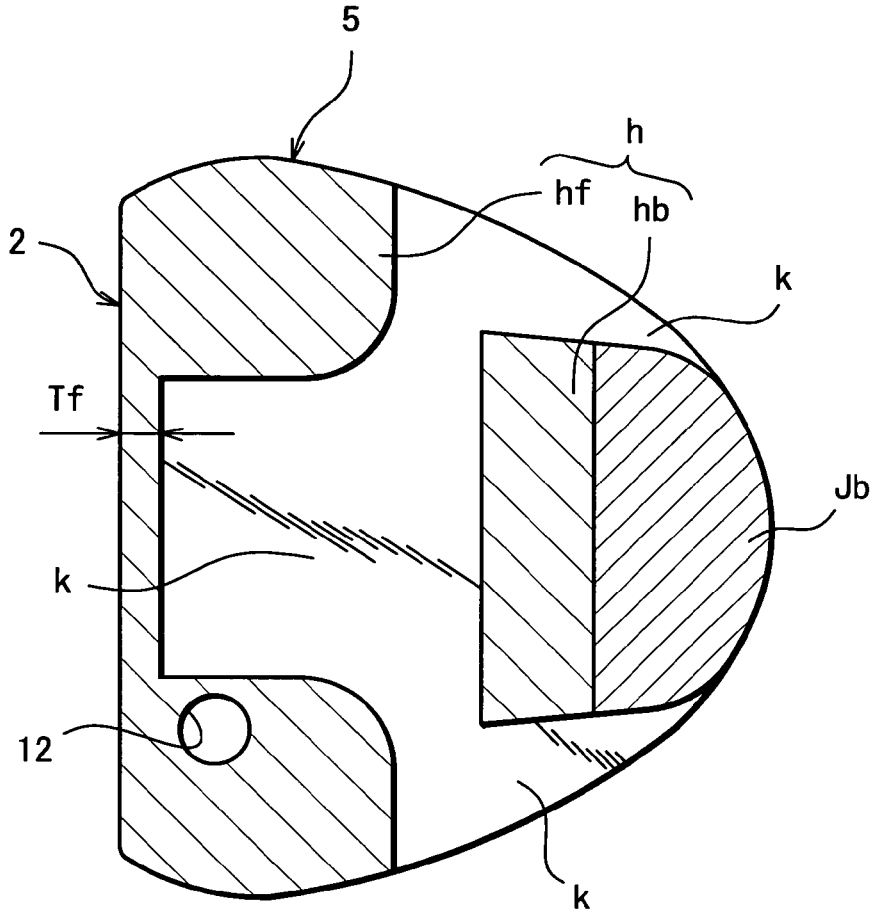
FIG. 9A is a sectional view taken on the line A-A in FIG. 8B.
Figure 9B:
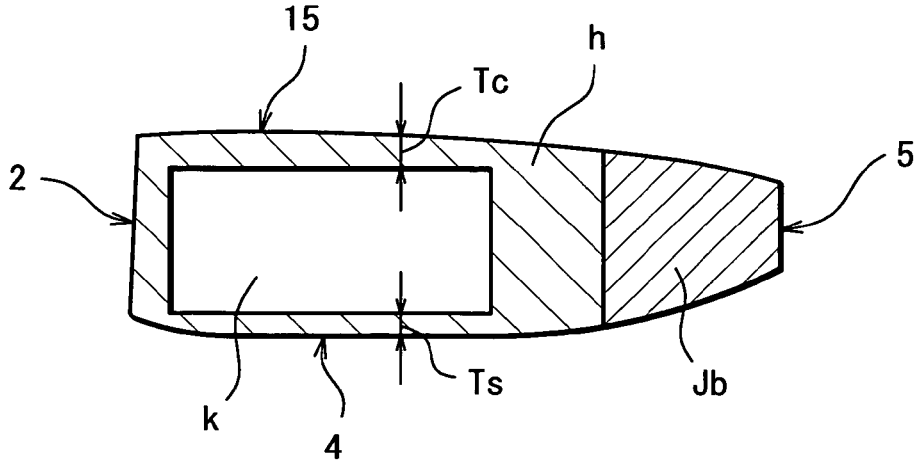
FIG. 9B is a sectional view taken on the line B-B in FIG. 8A.

A mode of Comparative Example 1 is shown in FIG. 8 and FIG. 9. FIG. 8A is a plan view of Comparative Example 1 as viewed from the top surface side, whereas FIG. 8B is a side view thereof as viewed from the heel side. FIG. 9A is a sectional view taken on the line A-A in FIG. 8B, whereas FIG. 9B is a sectional view taken on the line B-B in FIG. 8A.

Comparative Example 1 has a structure analogous to that of Example 2. However, this example does not include the weight members J, which are provided on the toe side and the heel side of the face-side portion hf of the head body h of Example 2. In other words, the weight members J are replaced by the face-side portion hf. On the other hand, the back-side weight member Jb (formed from copper) has different sizes from those of Example 2. This back-side weight member has a maximum top-sole width Hc of 23 mm (see FIG. 8B) and a face-back width Dc of 22 mm (see FIG. 8A).

Figure 10A:
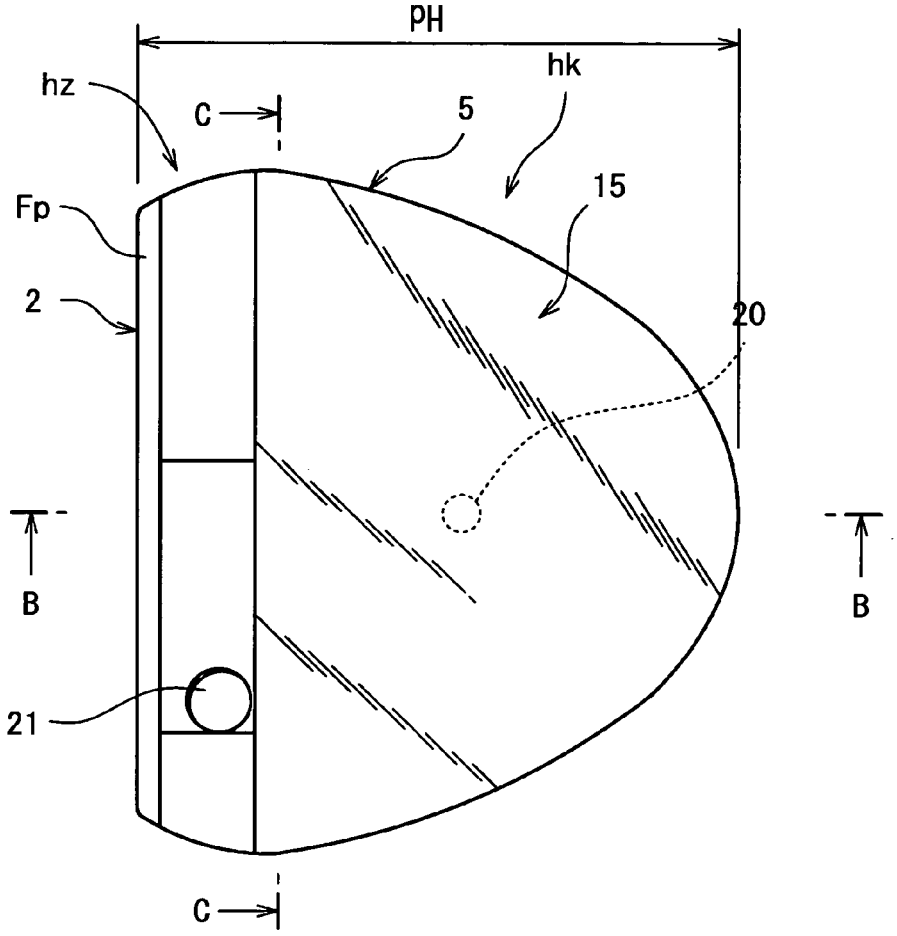
FIG. 10A is a plan view of Comparative Example 2 as viewed from the top surface side.
Figure 10B:
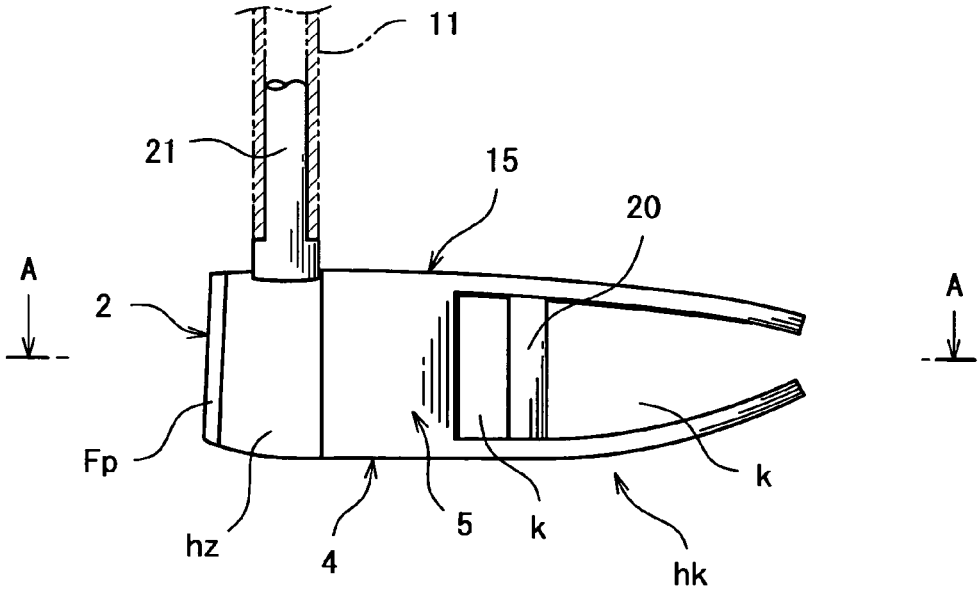
FIG. 10B is a side view of Comparative Example 2 as viewed from the heel side.
Figure 11A:
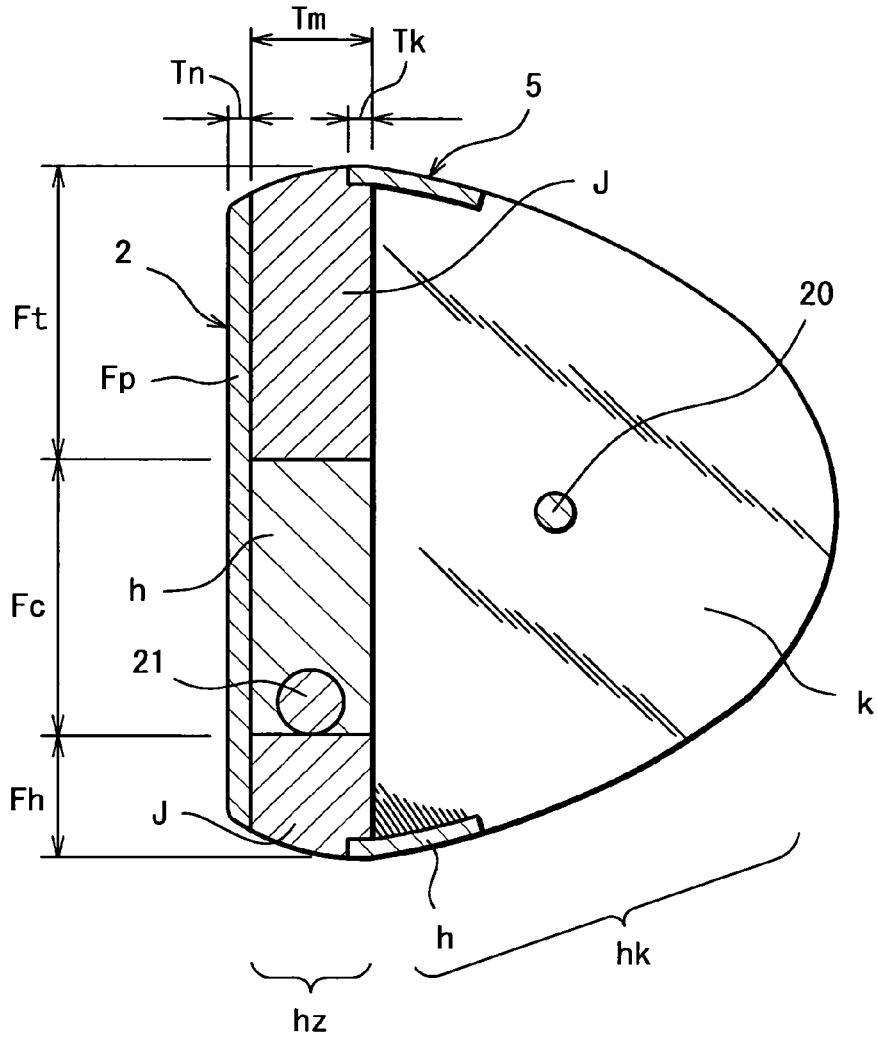
FIG. 11A is a sectional view taken on the line A-A in FIG. 10B.
Figure 11B:
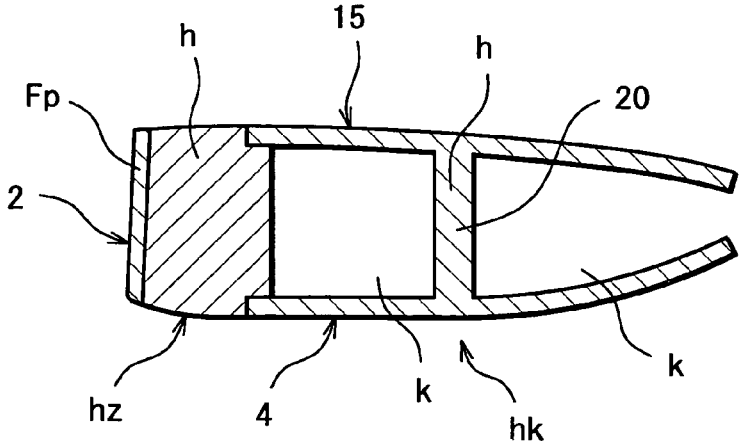
FIG. 11B is a sectional view taken on the line B-B in FIG. 10A.
Figure 12:
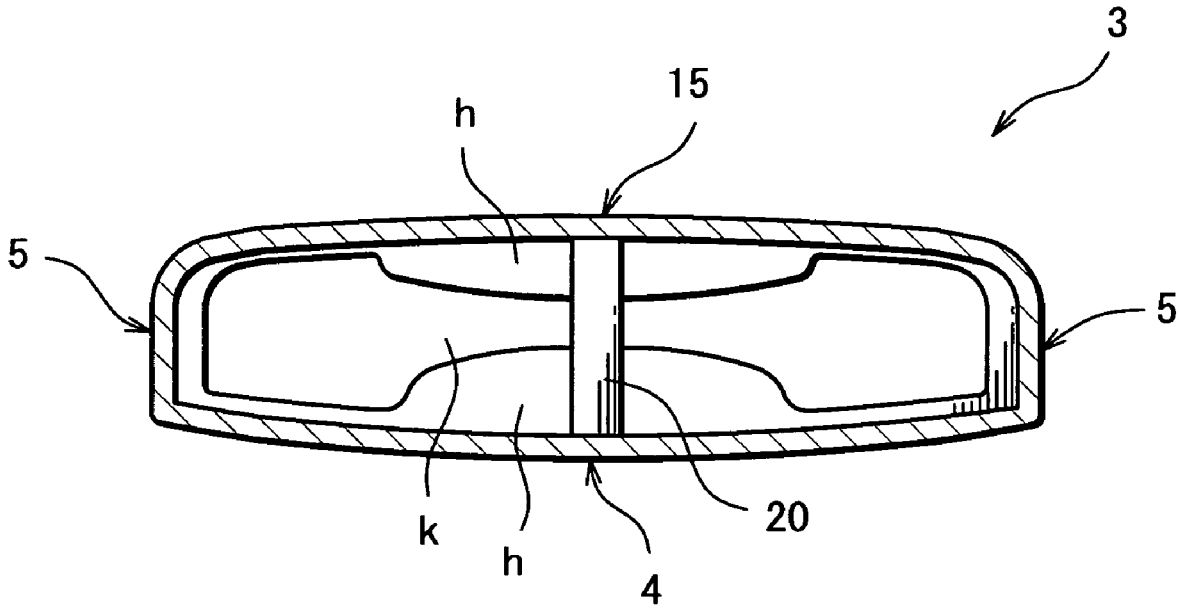
FIG. 12 is a sectional view taken on the line C-C in FIG. 10A.

A mode of Comparative Example 2 is shown in FIG. 10A, FIG. 10B, FIG. 11A, FIG. 11B and FIG. 12. FIG 12A is a plan view of Comparative Example 2 as viewed from the top surface side, whereas FIG 10B is a side view thereof as viewed from the heel side. FIG. 11A is a sectional view taken on the line A-A in FIG. 10B, whereas FIG. 11B is a sectional view taken on the line B-B in FIG. 10A. FIG. 12 is a sectional view taken on the line C-C in FIG. 10A.

In Comparative Example 2, the cavity k is formed larger than the aforesaid cavity of Examples 1, 2 and Comparative Example 1. The head body h of this comparative example does not include the back-side portion hb nor the back-side weight member Jb. The cavity k is opened not only toward the toe side and the heel side of the head 3 but also toward the back side of the head 3.

In the head 3 of Comparative Example 2, the face surface 2 is constituted by an aluminum alloy face plate Fp having the same contour as that of the face surface 2. Disposed on a back side of the face plate Fp is a head front portion hz formed of a thick plate having substantially the same shape as the face plate Fp and a greater thickness than the face plate Fp. The head front portion and the face plate Fp are in parallel relation. Furthermore, a head back portion hk is disposed on a back side of the head front portion hz. As shown in FIG. 12, the head back portion hk has an opening on a face-surface side thereof, the opening having substantially the same contour as that of the head front portion hz. A back-side portion of the head front portion hz is fitted in this opening whereby the head front portion hz and the head back portion hk are joined together. An interior of the head back portion hk is a hollow portion except that a single column 20 extends upright between an inner side of the top surface 15 and an inner side of the sole surface 4. Such a hollow portion defines the cavity k of the head 3. In the head 3, this cavity k is open toward the head-back side, and toward the toe side and the heel side of the head.

In the head front portion hz, a heel-side portion and a toe-side portion thereof are formed from brass, whereas an intermediate portion thereof with respect to the toe-heel direction is formed from an aluminum alloy. The toe-side portion has a toe-heel length Ft of 42 mm, whereas the heel-side portion has a toe-heel length Fh of 17 mm. The intermediate portion of aluminum alloy has a toe-heel length Fc of 38 mm. The thickness Tn of the face plate Fp is 3 mm, whereas the thickness Tm of the head front portion hz is 16 mm. The head front portion hz is fitted in the head back portion hk by a fit-in length Tk of 3 mm.

Unlike Comparative Example 1 and Examples 1, 2, Comparative Example 2 includes a hosel 21. The hosel 21 is a so-called over hosel which is formed from brass and has an axial length of 70 mm. The shaft 11 is assembled to the head 3 by inserting the hosel 21 into the pipe-shaped shaft 11 and bonding the hosel to the shaft. As shown in FIG. 10B, the hosel 21 is formed with a step of substantially the same dimension as the thickness of the shaft 11 at an intermediate point in the axial direction thereof, so that the shaft 11 with its end face abutted against the step is joined with the head 3 (see FIG. 10B).

As described above, Examples 1, 2 and Comparative Examples 1, 2 increase the freedom of designing the position of the center of gravity of the head by arbitrarily controlling: the position or size of the cavity k; the specific gravity of the head body h; the existence/nonexistence of the face-side portion hf and the position or the size thereof; the existence/nonexistence of the back-side portion hb and the position or the size thereof; the existence/nonexistence of the weight members J on the toe and heel sides and the positions or the sizes thereof; the specific gravity of the weight member J; the existence/nonexistence of the back-side weight member Jb and the position or the size thereof; the specific gravity of the back-side weight member Jb; the existence/nonexistence of the head front portion hz and the position or the size thereof; the existence/nonexistence of the hosel 21, the material thereof and the length or the position thereof; and such. This provides ease of setting the first moment M1 to the third moment M3 of the golf putter 1 to desired values.

The first moment M1 and the second moment M2 were measured using a measurement instrument for moment of inertia, Model No. RK/005-002 commercially available from Inertia Dynamics, Inc. The first moment M1 and the second moment M2 were measured while securely holding the putter in a position wherein the shaft axis was directed horizontally, the reference point P was positioned on a rotary axis of the measurement instrument for moment of inertia, and the face surface 2 was oriented horizontally or vertically.

On the other hand, the third moment M3 was measured using a measurement instrument for moment of inertia produced by SRI Sports Ltd., because it is difficult for the above measurement instrument to take measurement on the third moment. This instrument is adapted for reciprocal rotational motion about a vertical shaft as the rotary axis, and is equipped with a chuck (fixing jig) capable of maintaining the golf putter in a pendent position wherein the grip end is the upper end and the shaft axis is oriented vertically. The principles of the measurement per se are the same as those of the aforesaid measurement instrument available from Inertia Dynamics, Inc. The instrument is adapted to subject a measurement object to the reciprocal rotational motion with a desired axis (here, the third axis A3) of the measurement object aligned with the rotary axis of the instrument and to take measurement on the period of the reciprocal rotational motion. Then, the moment of inertia about the axis may be calculated from the value of this period. In this measurement step, the upper end of the grip, positioned on the upside, was fixed by means of the aforesaid chuck, while the putter with the third axis aligned with the rotary axis of the instrument was reciprocally rotated as maintaining the shaft axis or the third axis A3 vertically oriented. In this state, the measurement was taken on the period $T_3$ of the rotational motion and then, the third moment M3 was calculated using the following equation:

$$M3=C_1\times(T_3/\pi)^2-Mt,$$

where $C_1$ denotes a correction constant for the moment of inertia obtained by taking measurement on a known object, and Mt denotes a moment of inertia of the aforesaid chuck.

What is claimed is:

1. A golf putter designed to have a weight balance wherein:

three moments of inertia M1, M2, and M3 defined in units of $g\cdot cm^2$ by the following descriptions (1) to (3) satisfy the following expressions (A) and (B):

$$M1-M2<12000 \quad (A)$$

$$M1>M2>M3 \quad (B),$$

(1) M1: a moment of inertia of the putter about a first axis through a reference point P, parallel to a face surface and perpendicular to a shaft axis, the reference point P defined by an intersection of the shaft axis and a perpendicular line from a putter-supporting point on the shaft to the shaft axis in a static balance state of the one-point supported putter;

(2) M2: a moment of inertia of the putter about a second axis through the reference point P and perpendicular to the first axis and to the shaft axis; and (3) M3: a moment of inertia of the putter about a third axis defined by the shaft axis.

2. The golf putter according to claim 1, wherein the M3 is more than 5000 $g \cdot cm^2$.

3. A method of designing a golf putter, which defines a weight balance of the putter considering a correlation of magnitudes of three moments of inertia M1, M2, and M3 $g \cdot cm^2$ defined by the following descriptions (1) to (3) and a value of M1−M2, (1) M1: a moment of inertia of the putter about a first axis through a reference point P, parallel to a face surface and perpendicular to a shaft axis, the reference point P defined by an intersection of the shaft axis and a perpendicular line from a putter-supporting point on the shaft to the shaft axis in a static balance state of the one-point supported putter;

(2) M2: a moment of inertia of the putter about a second axis through the reference point P and perpendicular to the first axis and to the shaft axis; and (3) M3: a moment of inertia of the putter about a third axis defined by the shaft axis; and wherein the method comprises the following steps:

adjusting the magnitudes of M1, M2 and M3 to achieve a predetermined correlation of M1, M2 and M3; and further adjusting the magnitudes of M1 and M2, as needed, so that M1 is greater than M2, and the value of M1−M2 is no greater than a predetermined magnitude.

4. The method of designing a golf putter according to claim 3, which defines the M1, the M2, and the M3 $g \cdot cm^2$ in a manner to provide a weight balance satisfying following expressions (A) and (B):

$$M1-M2<12000 \quad \text{(A)}$$

$$M1>M2>M3 \quad \text{(A).}$$

* * * * *